US009513047B2

(12) United States Patent
Chellappan et al.

(10) Patent No.: US 9,513,047 B2
(45) Date of Patent: Dec. 6, 2016

(54) DOOR MODULE ASSEMBLY FOR A REFRIGERATOR APPLIANCE

(71) Applicant: General Electric Company, Schnectady, NY (US)

(72) Inventors: Bagawathkumar Chellappan, Louisville, KY (US); Madan Gopal Reddy Pathapati, Hyderabad (IN); Louis Anthony Wantland, Louisville, KY (US); Ratnakar Sahasrabudhe, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 165 days.

(21) Appl. No.: 14/151,870

(22) Filed: Jan. 10, 2014

(65) Prior Publication Data

US 2015/0198365 A1 Jul. 16, 2015

(51) Int. Cl.
*F25D 23/04* (2006.01)
*F25D 25/02* (2006.01)

(52) U.S. Cl.
CPC ..... *F25D 23/04* (2013.01); *F25D 25/025* (2013.01); *A47B 2210/175* (2013.01); *F25D 2500/02* (2013.01)

(58) Field of Classification Search
CPC ..... F25D 23/02; F25D 25/04; F25D 23/025; F25D 2400/06; F25D 25/028; F25D 2500/02; A47B 2210/17; A47B 2210/175
USPC ..... 312/321.5
See application file for complete search history.

(56) References Cited

U.S. PATENT DOCUMENTS 2,808,310 A 8/1954 Patterson, Jr.
5,193,892 A 3/1993 Swindell
7,469,980 B2 * 12/2008 Koo ..... F25D 23/04 312/321.5
8,302,423 B2 * 11/2012 Lee ..... F25C 1/04 62/337
8,607,588 B2 * 12/2013 Oh ..... F25D 25/025 62/465
8,864,252 B1 * 10/2014 Rodriguez Cobas ... F25D 23/04 312/321.5
2005/0156494 A1 * 7/2005 Bergmann ..... A47B 88/0407 312/404
2007/0157655 A1 * 7/2007 Eveland ..... A47F 1/087 62/377
2010/0270902 A1 * 10/2010 Kim ..... F25D 17/042 312/405.1
2013/0026900 A1 * 1/2013 Oh ..... F25D 23/02 312/401

FOREIGN PATENT DOCUMENTS

CN 1896663 A 1/2007
WO WO 2012062877 A2 5/2012

* cited by examiner

*Primary Examiner* — Daniel J Troy
*Assistant Examiner* — Ryan A Doyle
(74) *Attorney, Agent, or Firm* — Dority & Manning, P.A.

(57) ABSTRACT

A door module assembly for a refrigerator door of a refrigerator appliance may generally include a mounting bracket configured to be removably coupled to the refrigerator door to allow the mounting bracket to be moveable between a plurality of mounting locations defined along a height of the refrigerator door. The door module assembly may also include a door tray movable relative to the mounting bracket and at least one translation device configured in operative association with adjacent walls of the door tray and the mounting bracket. The translation device may be configured such that the door tray is movable relative to the mounting bracket in a horizontal direction between a retracted position and an extended position. Moreover, an open tray volume defined by the door tray may be accessible when the door tray is in both the retracted position and the extended position.

10 Claims, 20 Drawing Sheets

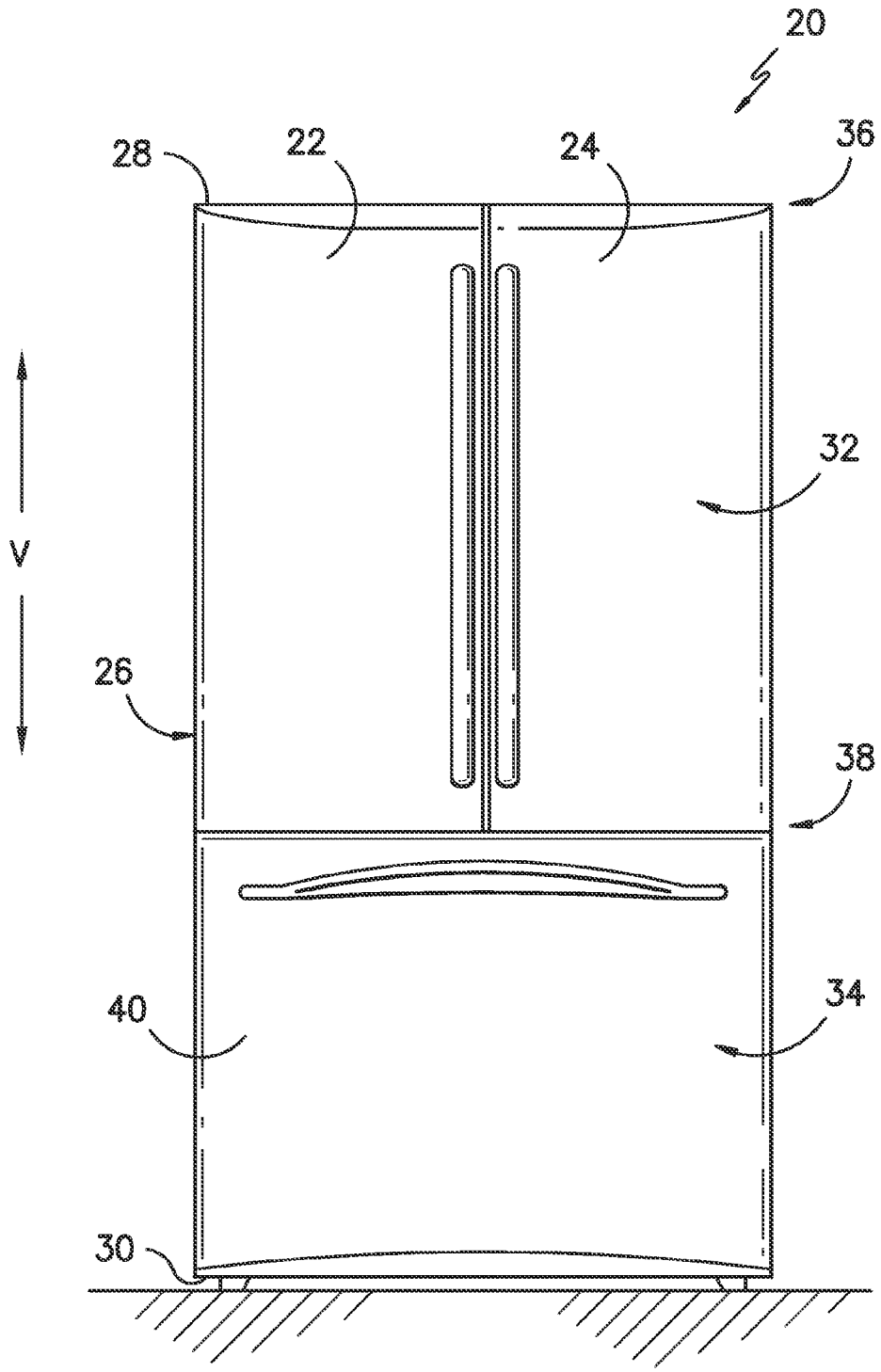
FIG. —1—

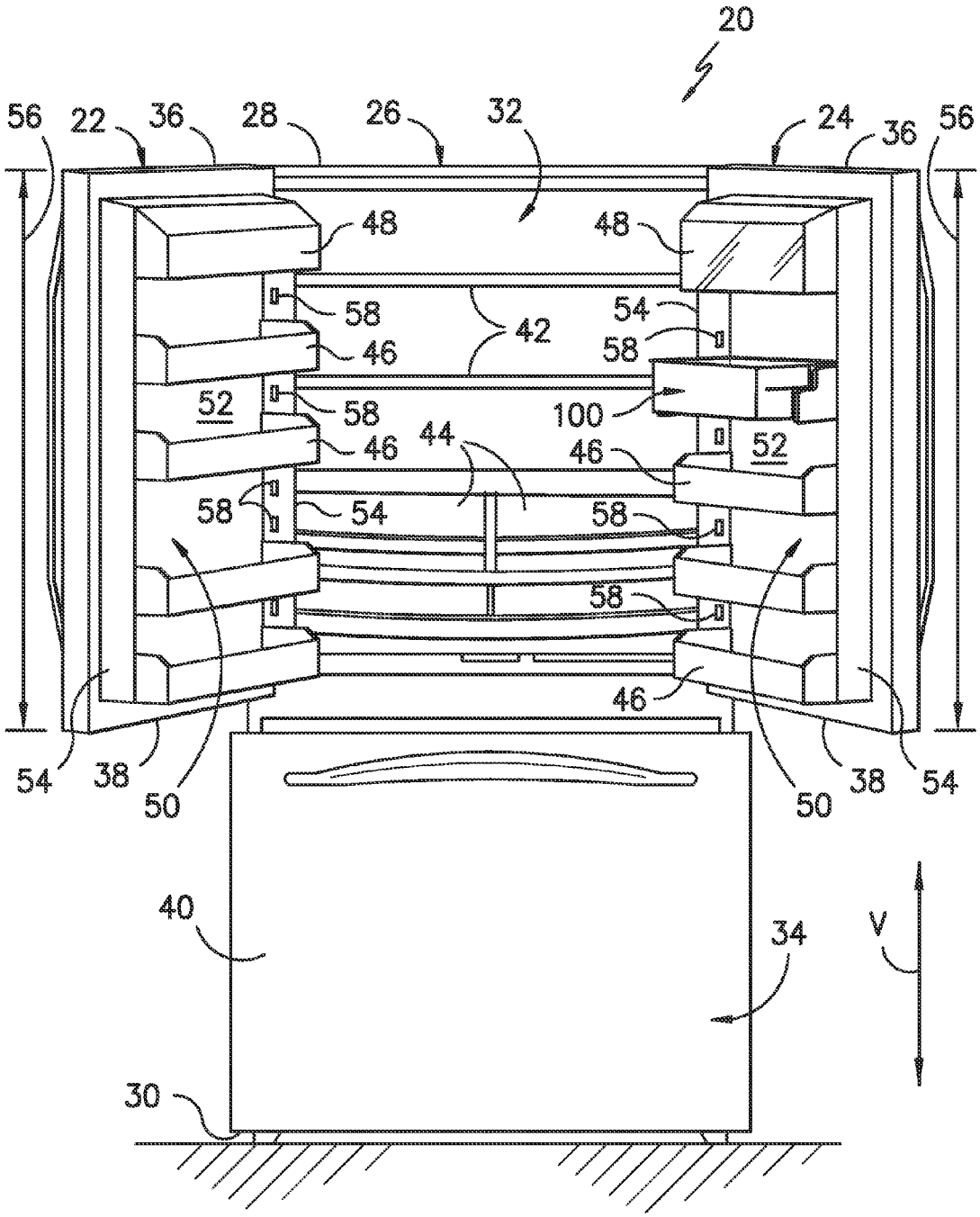
FIG. —2—

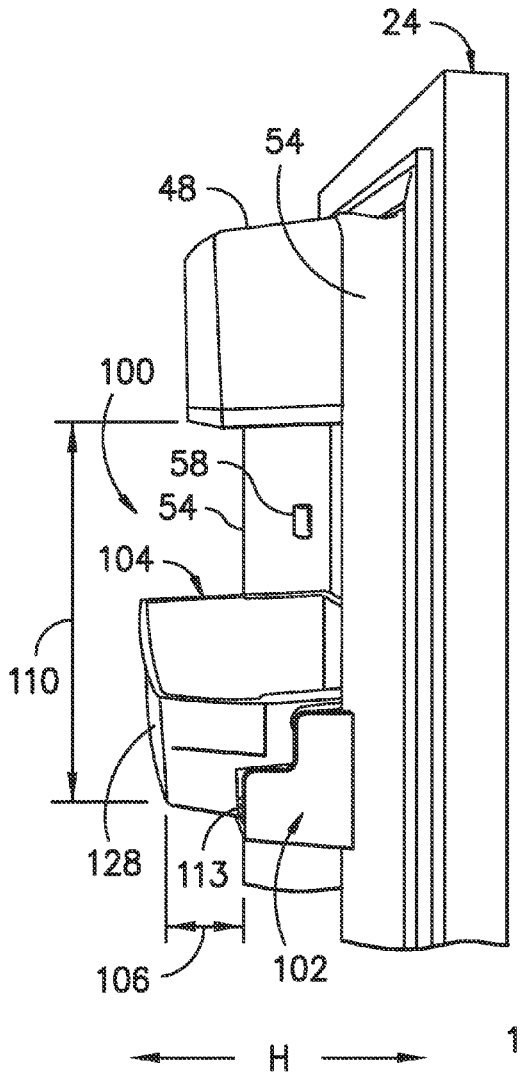
FIG. —3—
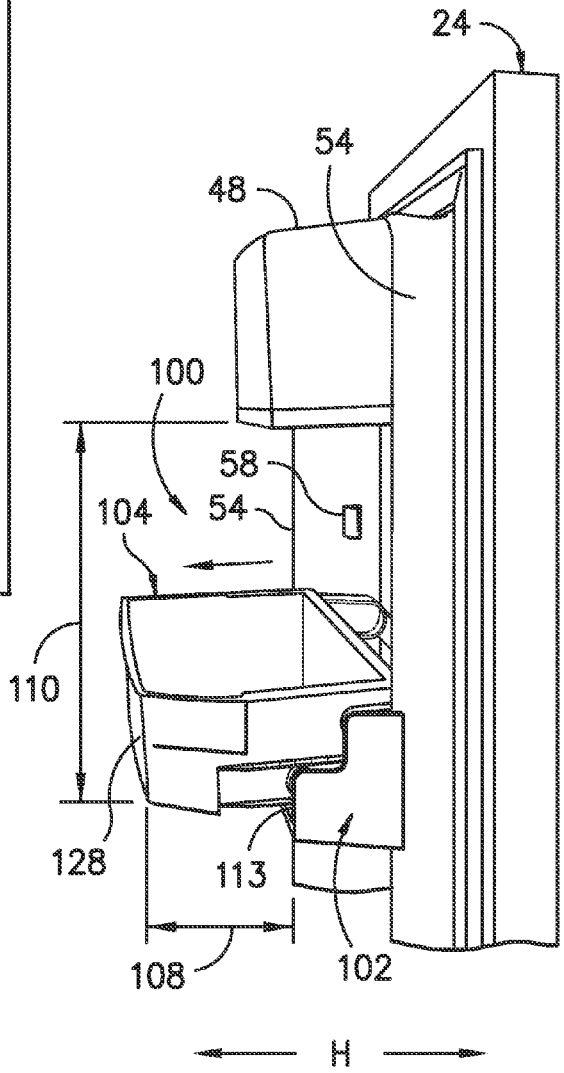
FIG. —4—

DOOR MODULE ASSEMBLY FOR A REFRIGERATOR APPLIANCE

FIELD OF THE INVENTION

The present subject matter relates generally to refrigerator appliances and, more particularly, to a door module assembly for a refrigerator door of a refrigerator appliance.

BACKGROUND OF THE INVENTION

Refrigerator appliances generally include a cabinet or housing that defines a chilled chamber for the receipt of refrigerated items, such as food articles. In addition, refrigerator appliances typically include various storage components mounted within the chilled chamber that are designed to facilitate storage of the refrigerated items therein. Such storage components can include racks, bins, shelves, or drawers that receive refrigerated items and assist with organizing and arranging of such items within the chilled chamber.

It is often desirable to maximize the usable storage volume defined within the chilled chamber of a refrigerator appliance, particularly with reference to the storage volume defined along the inner liners of the refrigerator doors. Thus, from a design point-of-view, it may be desirable to minimize the spacing defined between adjacent storage components located along the inner liner of a given refrigerator door. However, by minimizing such spacing, it can make it difficult to load and unload refrigerated items (especially relatively tall items, such as gallon and/or 2 liter beverage containers) into/from the storage components located on the door. For instance, refrigerated items may often need to be turned sideways or otherwise manipulated to allow such items to be loaded into and/or unloaded from adjacent storage components. This can be very frustrating for consumers. As a result, appliance manufacturers often increase the spacing between adjacent storage components to provide improved consumer experience. However, this leads to a reduction in the overall usable space within a refrigerator appliance.

Accordingly, a refrigerator appliance with features for increasing the usable storage space defined within the chilled chamber of the appliance would be useful. In particular, a refrigerator appliance with an improved door module assembly that permits refrigerated items to be easily loaded into and/or unloaded from the assembly while allowing the spacing defined between adjacent storage components to be reduced would be welcomed in the technology.

BRIEF DESCRIPTION OF THE INVENTION

Aspects and advantages of the invention will be set forth in part in the following description, or may be obvious from the description, or may be learned through practice of the invention.

In one aspect, the present subject matter is directed to a door module assembly for a refrigerator door of a refrigerator appliance. The door module assembly may generally include a mounting bracket configured to be removably coupled to the refrigerator door to allow the mounting bracket to be moveable between a plurality of mounting locations defined along a height of the refrigerator door. The mounting bracket may include a first bracket sidewall and a second bracket sidewall. The first bracket sidewall may be spaced apart from the second bracket sidewall so as to define an open bracket volume between the first and second bracket sidewalls. The door module assembly may also include a door tray configured to be at least partially received within the open bracket volume. The door tray may include a first tray sidewall, a second tray sidewall, a front tray wall and a rear tray wall. The door tray may define an open tray volume between the first and second tray sidewalls and between the front and rear tray walls for containing refrigerated items. In addition, the door module assembly may include at least one translation device configured in operative association with adjacent walls of the mounting bracket and the door tray. The translation device may be configured such that the door tray is movable relative to the mounting bracket in a horizontal direction between a retracted position, wherein the front tray wall is spaced apart from a forward edge of the first and second bracket sidewalls by a first distance, and an extended position, wherein the front tray wall is spaced apart from the forward edge by a second distance that is greater than the second distance. Moreover, the open tray volume defined by the door tray may be accessible when the door tray is in both the refracted position and the extended position.

In another aspect, the present subject matter is directed to a refrigerator appliance. The refrigerator appliance may generally include a housing defining a refrigerator chamber and refrigerator door pivotally coupled to the housing. The refrigerator door may be movable between an opened position and a closed position for accessing the refrigerator chamber. The refrigerator door may include a liner defining liner sidewalls. The refrigerator appliance may also include a door module assembly configured to be removably coupled between the liner sidewalls. The door module assembly may include a mounting bracket having a first bracket sidewall and a second bracket sidewall. The first bracket sidewall may be spaced apart from the second bracket sidewall so as to define an open bracket volume between the first and second bracket sidewalls. The door module assembly may also include a door tray configured to be at least partially received within the open bracket volume. The door tray may include a first tray sidewall, a second tray sidewall, a front tray wall and a rear tray wall. The door tray may define an open tray volume between the first and second tray sidewalls and between the front and rear tray walls for containing refrigerated items. In addition, the door module assembly may include at least one translation device configuration in operative association with adjacent walls of the mounting bracket and the door tray. The translation device may be configured such that the door tray is movable relative to the mounting bracket in a horizontal direction between a refracted position, wherein the front tray wall is spaced apart from a forward edge of the first and second bracket sidewalls by a first distance, and an extended position, wherein the front tray wall is spaced apart from the forward edge by a second distance that is greater than the second distance. Moreover, the open tray volume defined by the door tray may be accessible when the door tray is in both the retracted position and the extended position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 1 illustrates a front view of one embodiment of a refrigerator appliance, particularly illustrating the refrigerator doors of the appliance in a closed position;

FIG. 2 illustrates another front view of the refrigerator application shown in FIG. 1, particularly illustrating the refrigerator doors in an opened position;

FIG. 3 illustrates a partial side view of one of the refrigerator doors shown in FIG. 2 having one embodiment of a door module assembly installed thereon in accordance with aspects of the present subject matter, particularly illustrating a door tray of the door module assembly in a retracted position;

FIG. 4 illustrates another partial side view of the refrigerator door and door module assembly shown in FIG. 3, particularly illustrating the door tray in an extended position;

DETAILED DESCRIPTION OF THE INVENTION

Figure 5:
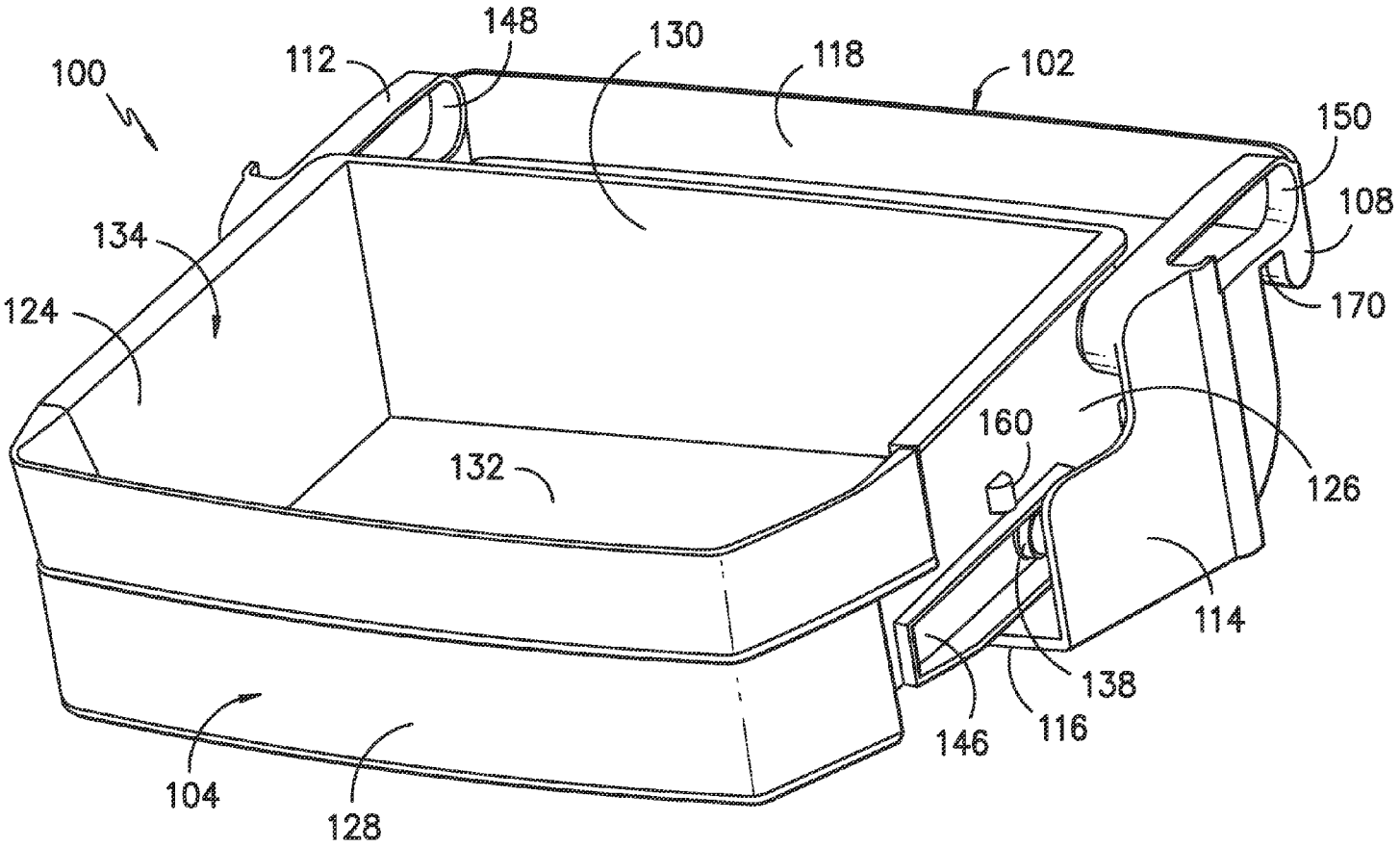
FIG. 5 illustrates a top, front perspective view of one embodiment of a door module assembly suitable for use within a refrigerator appliance in accordance with aspects of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Referring now to the drawings, FIGS. 1 and 2 illustrate one embodiment of a refrigerator appliance 20 in accordance with aspects of the present subject matter. Specifically, FIG. 1 illustrates a front view of the refrigerator appliance 20 with refrigerator doors 22, 24 of the appliance 20 shown in a closed position. Additionally, FIG. 2 illustrates another front view of the refrigerator appliance 20 with the refrigerator doors 22, 24 shown in an open position.

As shown in the illustrated embodiment, the refrigerator appliance 20 may generally include a cabinet or housing 26 that extends between a top 28 and a bottom 30 along a vertical direction V. As is generally understood, the housing 26 may define chilled chambers for storing refrigerated items, such as food articles. For example, as shown in FIGS. 1 and 2, the refrigerator appliance 20 is configured as a bottom mount refrigerator. Thus, the housing 26 may define a refrigerator chamber 32 extending from the top 28 of the housing 26 and a freezer chamber 34 extending from the refrigerator chamber 30 to the bottom 30 of the housing 26. However, it should be appreciated that, in alternative embodiments, the refrigerator appliance 20 may be configured as any other suitable type or style of refrigerator such as, for example, a top mount refrigerator or a side-by-side style refrigerator. Accordingly, one of ordinary skill the art should be appreciate that the present subject matter need not be limited to any particular type of refrigerator configuration.

Additionally, the refrigerator appliance 20 may include one or more doors for accessing the various chambers 32, 34 defined therein. For instance, as shown in the illustrated embodiment, the refrigerator appliance 20 may include first and second refrigerator doors 22, 24 for accessing the refrigerator chamber 32. In general, each refrigerator door 22, 24 may be configured to extend between a top portion 36 and a bottom portion 38 along the vertical direction V and may be rotatably hinged to an edge of the housing 26 for moving the door 22, 24 between a closed position (FIG. 1) and an open position (FIG. 2). In addition, the refrigerator appliance 20 may also include a freezer door 40 positioned below the refrigerator doors 22, 24 for selectively accessing the freezer chamber 34. For instance, as is generally understood, the freezer door 40 may be coupled to a freezer drawer (not shown) slidably mounted within freezer chamber 34.

As particularly shown in FIG. 2, the refrigerator appliance 20 may also include various storage components for storing refrigerated items within refrigerator chamber 32. For example, various racks 42 and/or bins 44 may be included within the interior of the refrigerator chamber 32. In addition, one or more shelves 46 and/or bins 48 (e.g., a dairy bin(s)) may be mounted to the interior of the refrigerator doors 22, 24. For example, as shown in FIG. 2, each refrigerator door 22, 24 may include an inner liner 50 having a rear liner wall 52 and liner sidewalls 54 extending in the vertical direction V along at least a portion of a height 56 of each door 22, 24 so as to define a storage area or volume. The shelves 46 and/or bins 48 may be mounted or otherwise positioned between the liner sidewalls 54 to allow refrigerated items (e.g., beverage containers) to be contained or otherwise supported within the storage volume.

Additionally, one or more door module assemblies 100 may also be mounted between the liner sidewalls 54 of one or both of the refrigerator doors 22, 24. For example, as shown in FIG. 2, the refrigerator appliance 20 includes a single door module assembly 100 installed onto one of the refrigerator doors 24. However, in other embodiments, the refrigerator appliance 20 may include any other suitable number of door modules assemblies 100 installed onto one or both of the refrigerator doors 22, 24. For instance, one or more of the shelves 46 and or bins 48 may be replaced with one or more of the disclosed door module assemblies 100.

In several embodiments, the door module assembly 100 may be configured to be positioned at any suitable location along the vertical length or height 56 each door 22, 24. Specifically, as shown in FIG. 2, a plurality of different mounting locations may be spaced apart along the height 56 of each refrigerator door 22, 24, with each mounting location including a pair of mounting tabs 58 (one of which is shown) projecting outwardly from the liner sidewalls 54. As will be described below, the disclosed door module assembly 100 may include corresponding mounting features configured to engage the mounting tabs 58, thereby allowing the door module assembly 100 to be initially mounted at a given mounting location, removed from such location and subsequently re-installed at any other suitable mounting location defined along the height 56 of either refrigerator door 22, 24.

Referring now to FIGS. 3 and 4, partial side views of one of the refrigerator doors 24 shown in FIG. 2 having one embodiment of a door module assembly 100 installed thereon are illustrated in accordance with aspects of the present subject matter. As shown, the door module assembly 100 may generally include a mounting bracket 102 and a door tray 104. As will be described below, the mounting bracket 104 may be configured to be removably coupled to the refrigerator door 24 (e.g. via the mounting tabs 58 projecting outwardly from the liner sidewalls 54) and may generally serve as a means for supporting the door tray 104 relative to the door 24.

Additionally, the door tray 104 may generally be configured to be movable relative to the mounting bracket 102 in a horizontal direction H between a retracted position (FIG. 3) and an extended position (FIG. 4). For example, as shown in FIG. 3, when the door tray 104 is in the retracted position, a front wall 128 of the door tray 104 may be spaced apart from a forward edge 113 of the mounting bracket 102 by a first distance 106. However, when the door tray 104 is moved to the extended position, the front wall 128 may be spaced apart from the forward edge 113 by a second distance 108 that is greater than the first distance 106. It should be appreciated that the difference between the first and second distances 106, 108 may generally correspond to any suitable length that allows the disclosed door module assembly 100 to function as described herein. However, in several embodiments, the differential between the first and second distances 106, 108 may range from about 2 inches to about 6 inches, such as from about 3 inches to about 5 inches or from about 3 inches to about 4 inches and any other subranges therebetween.

By configuring the door tray 104 to be movable between the retracted and extended positions, the door module assembly 100 may allow for refrigerated items of a certain height to be loaded into and/or unloaded from the door tray with improved ease and efficiency. For example, as shown in FIGS. 3 and 4, a vertical storage height 110 may be defined between the bottom of the door tray 104 and the bottom of an adjacent storage compartment (e.g. a shelf 46 or bin 48). For a refrigerated item having a vertical height that is slightly less than the vertical storage height 110 (e.g., a beverage container, such as a gallon milk carton or a two liter soft drink container), it is often difficult to load and unload the refrigerated item without the top of the item getting caught against the bottom of the adjacent storage compartment. However, using the disclosed door module assembly 100, the door tray 104 may be moved to the extended position to allow such refrigerated item(s) to be quickly and easily loaded into and unloaded from the door tray 104. Once the item(s) is loaded/unloaded, the door tray 104 may then be moved back to the retracted position to reduce the amount of space occupied by the door module assembly 100 when the refrigerator door 24 is closed.

Moreover, since the disclosed door module assembly 100 is open along its top (i.e., there is not a top or cover covering the door tray 104), the storage space defined by the door tray 104 may be accessed when the tray 104 is in both the retracted position and the extended position. Thus, for refrigerated items having shorter vertical heights, the items may be loaded into and/or unloaded from the door tray 104 without the need to move the tray 104 to the extended position.

Figure 6:
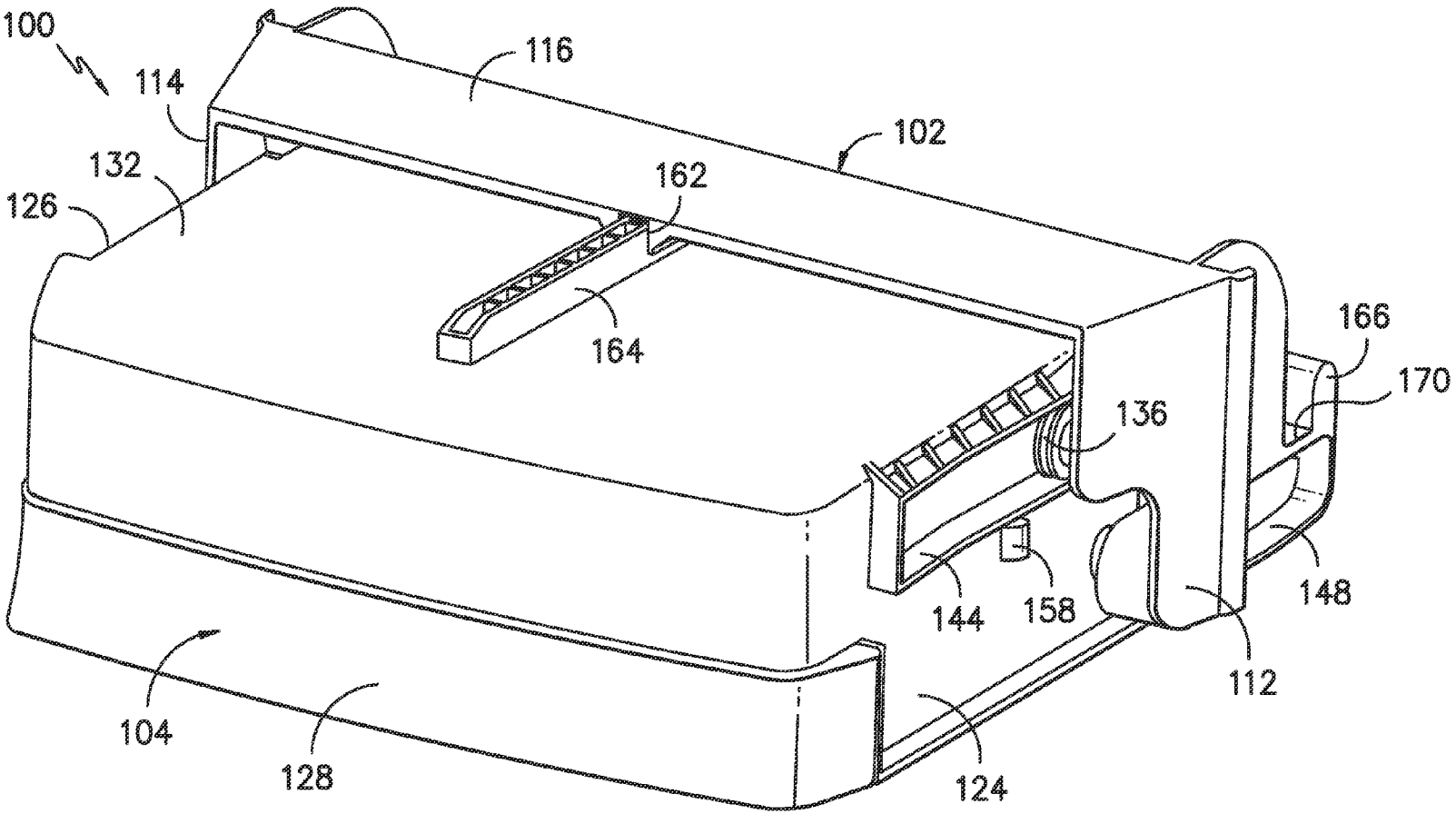
FIG. 6 illustrates a bottom, front perspective view of the door module assembly shown in FIG. 5.
Figure 7:
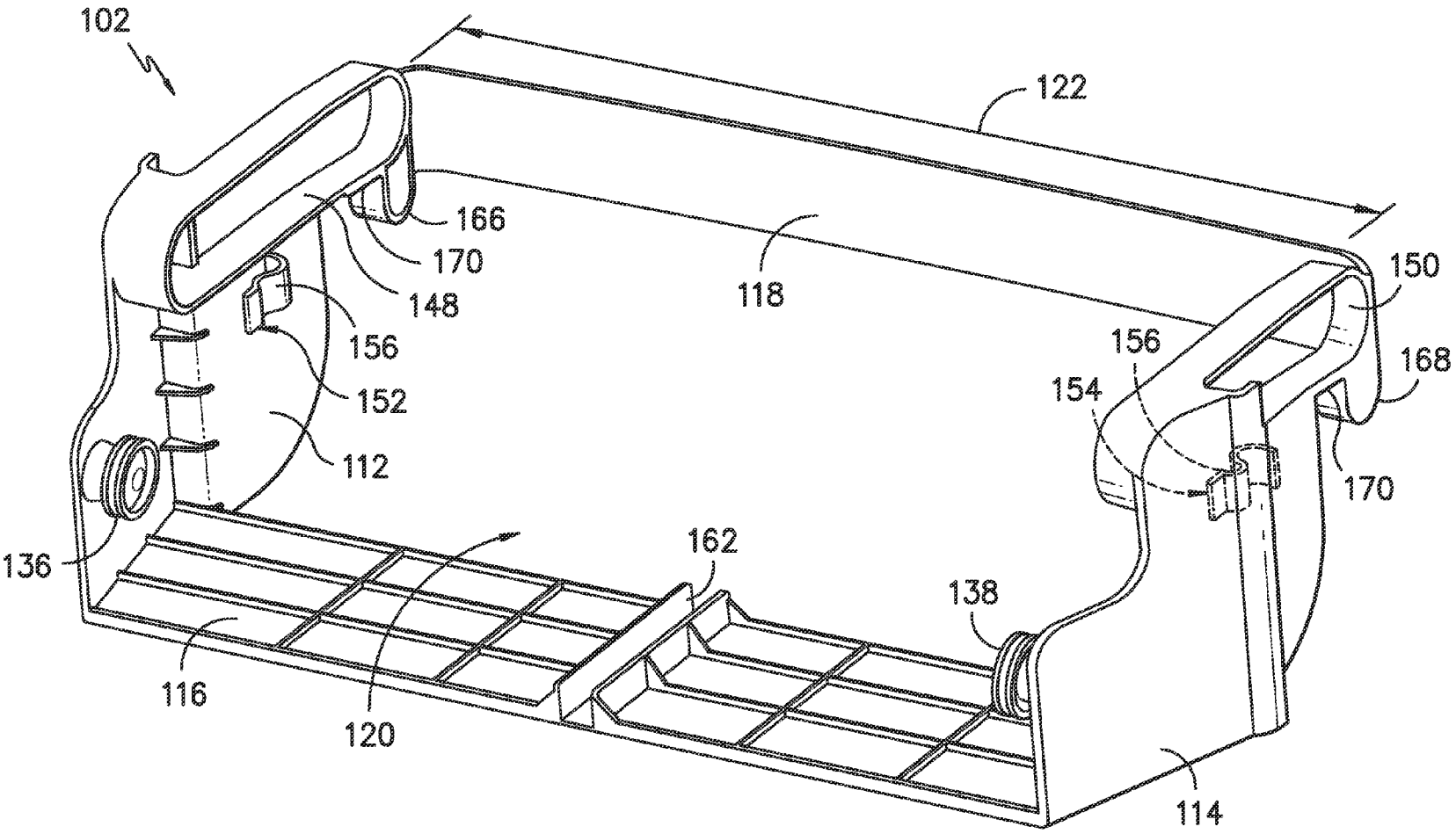
FIG. 7 illustrates a top, front perspective view of a mounting bracket of the door module assembly shown in FIG. 5.
Figure 8:
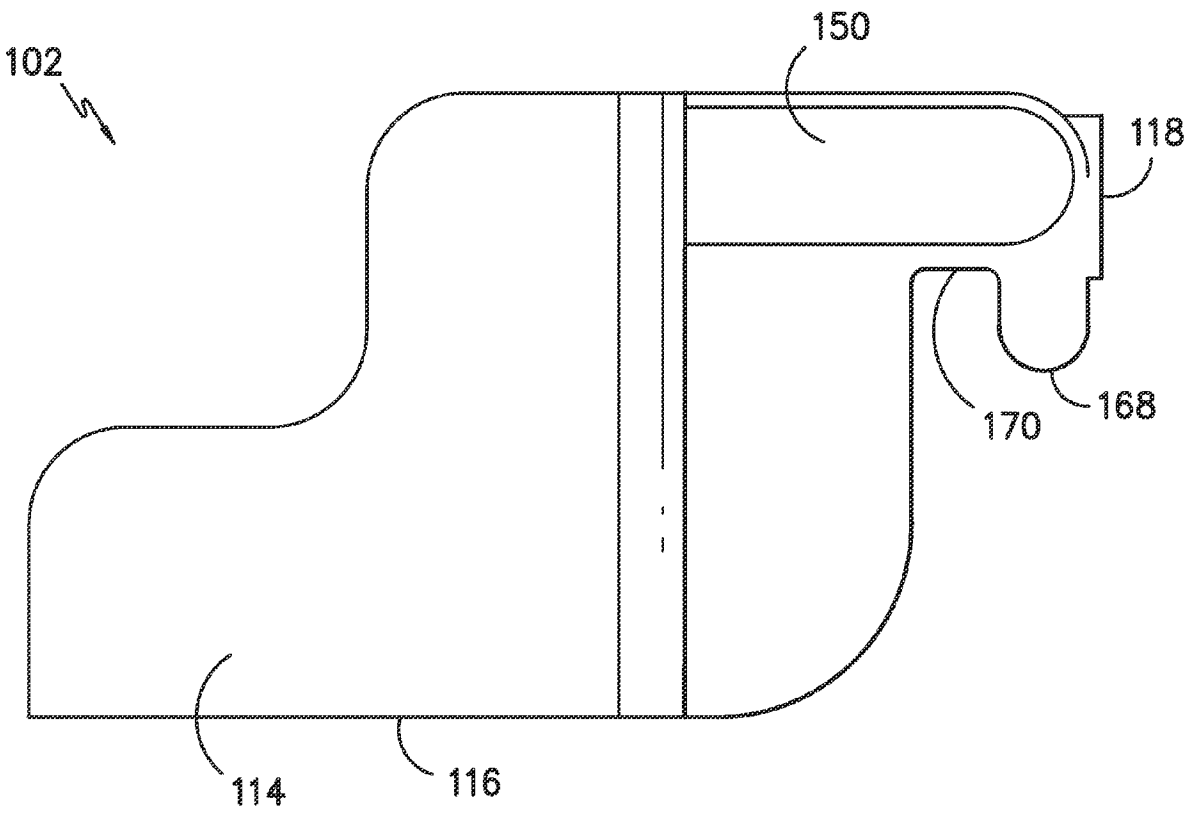
FIG. 8 illustrates a side view of the mounting bracket shown in FIG. 7.
Figure 9:
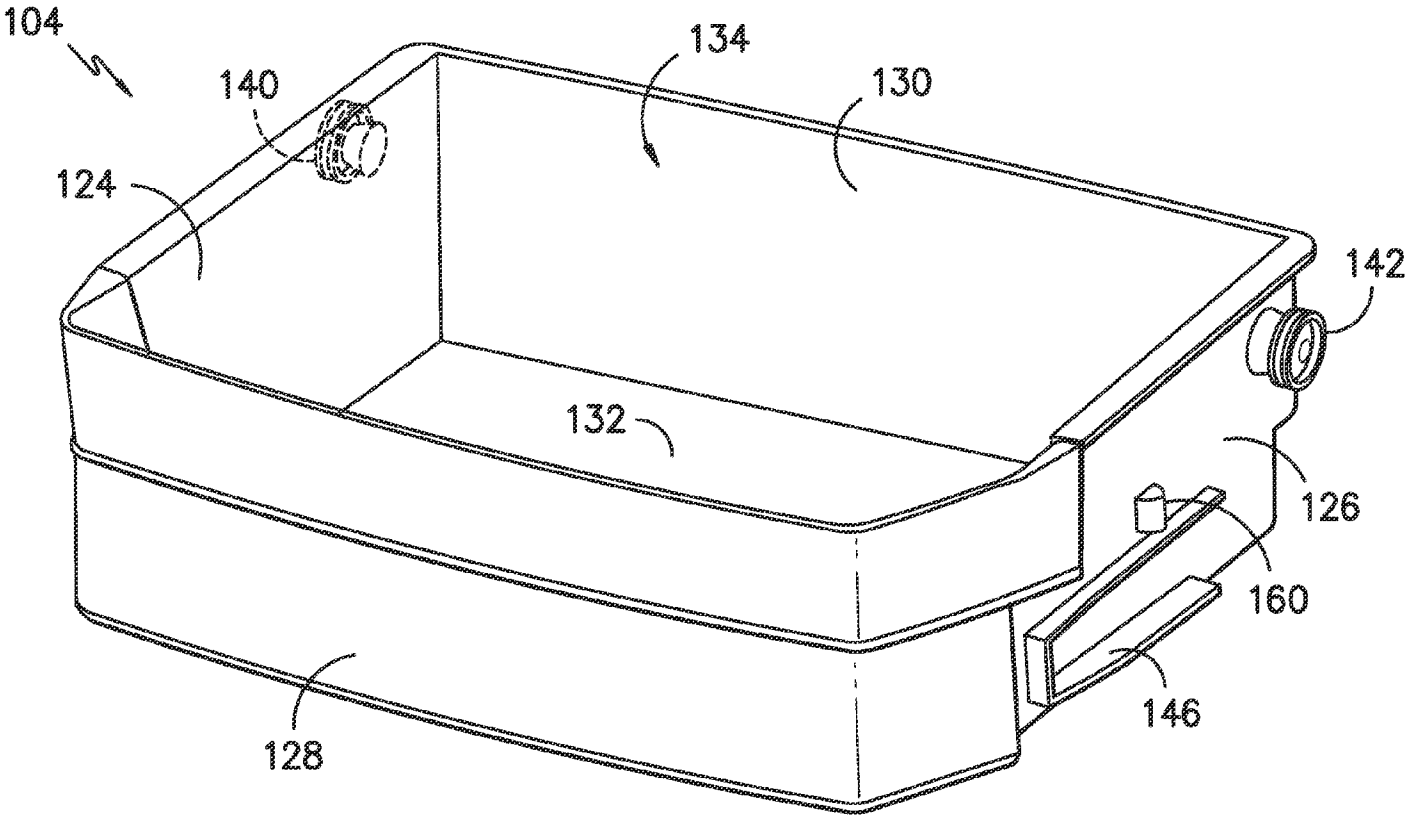
FIG. 9 illustrates a top, front perspective view of a door tray of the door module assembly shown in FIG. 5.
Figure 10:
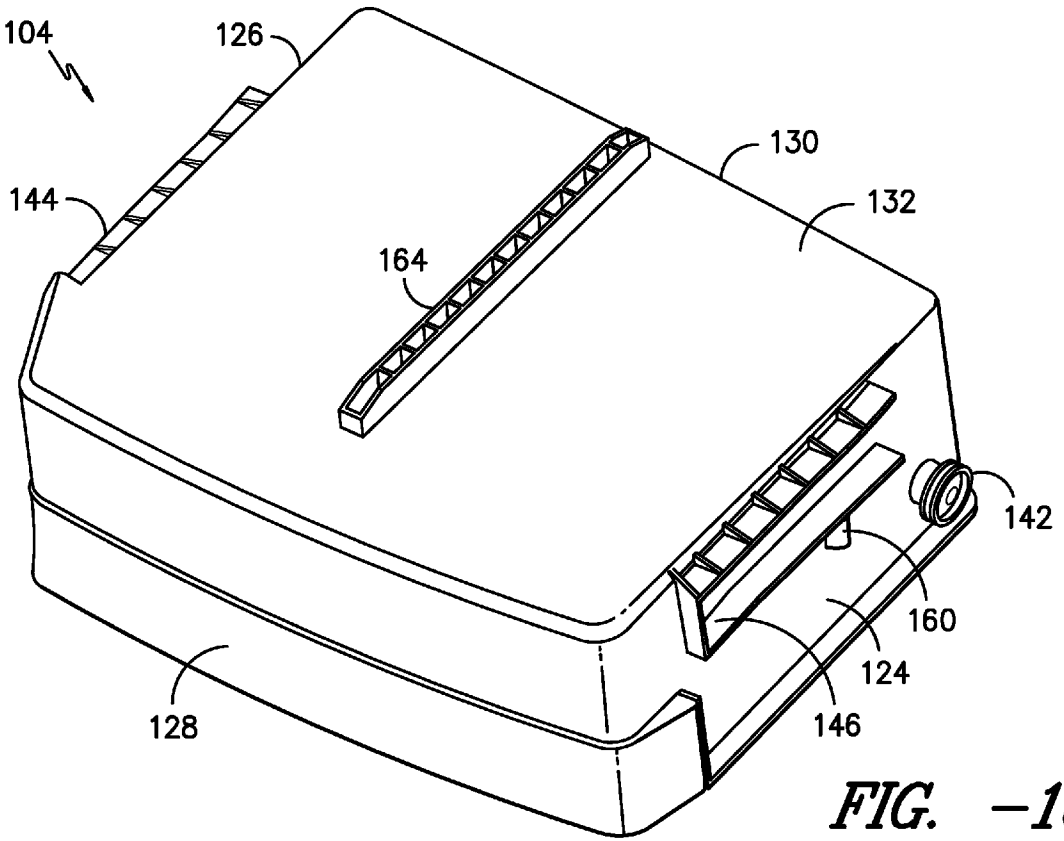
FIG. 10 illustrates a bottom, front perspective view of the door tray shown in FIG. 9.

Referring now to FIGS. 5-10, several views of the embodiment of the door module assembly 100 described above with reference to FIGS. 2-4 are illustrated in accordance with aspects of the present subject matter. Specifically, FIGS. 5 and 6 illustrates top and bottom perspective views, respectively, of the door module assembly 100. FIGS. 7 and 8 illustrate perspective and side views, respectively, of the mounting bracket 102 of the door module assembly 100. Additionally, FIGS. 9 and 10 illustrate top and bottom perspective views, respectively, of the door tray 104 of the door module assembly 100.

As indicated above, the disclosed door module assembly 100 may generally include a mounting bracket 102 and a door tray 104 movable relative to the mounting bracket 102 between retracted and extended positions. As particularly shown in FIG. 7, the mounting bracket 104 may generally include a first bracket sidewall 112, a second bracket sidewall 114 and bottom and rear bracket walls 116, 118, respectively, extending between the first and second bracket sidewalls 112, 114. In several embodiments, the first bracket sidewall 112 may be spaced apart from the second bracket sidewall 114 such that an open bracket volume 120 is defined between the sidewalls 112, 114, thereby allowing at least a portion of the door tray 104 to be received within the open volume 116. For example, as shown in FIG. 7, the first and second bracket sidewalls 112, 114 may be spaced apart by a cross-wise distance 122. In such an embodiment, a corresponding cross-wise dimension of the door tray 104 may generally be configured to be smaller than the cross-wise distance 122 to allow at least a portion of the door tray 104 to be inserted between the first and second bracket sidewalls 112, 114.

Additionally, as particularly shown in FIG. 9, the door tray 104 may generally include a first tray sidewall 124, a second tray sidewall 126, a front tray wall 128, a rear tray wall 130 and a bottom tray wall 132. In general, the various walls 124, 126, 128, 130, 132 may be positioned relative to one another so that an open storage area or volume 134 is defined between the walls. As indicated above, the open storage volume 134 may be configured for receiving and/or containing refrigerated items, such as beverage containers and/or other food articles.

Moreover, in several embodiments, the door module assembly 100 may include one or more translation devices associated with the mounting bracket 102 and/or the door tray 104 to allow door tray 104 to be moved relative to the mounting bracket 102 between the retracted and extended positions. In general, each translation device may correspond to any suitable device(s) that provides for relative motion between the mounting bracket 102 and the door tray 104. For instance, as shown in the illustrated embodiment, the translation devices correspond to wheels or rollers 136, 138, 140, 142. However, as will be described below, the translation devices may correspond to any other suitable device(s), such as slide mechanisms.

As shown in the illustrated embodiment, one or more rollers 136, 138, 140, 142 may be coupled to the sidewalls 112, 114, 124, 126 of the mounting bracket 102 and/or the door tray 104, with each roller 136, 138, 140, 142 being configured to be received within a corresponding roller slot 144, 146, 148, 148 defined within the adjacent sidewall 112, 114, 124, 126. For example, as particularly shown in FIG. 7, a first pair of rollers 136, 138 may be configured to be coupled to the first and second bracket sidewalls 112, 114 such that each roller 136, 148 extends inwardly from the sidewalls 112, 114. Specifically, a first bracket roller 136 may be coupled to and extend inwardly from the inner side of the first bracket sidewall 112 and a second bracket roller 138 may be coupled to and extend inwardly from the inner side of the second bracket sidewall 114. Moreover, as shown in FIGS. 9 and 10, the door tray 104 may include a first roller slot 114 extending along the outside of the first tray sidewall 124 and a second roller slot 116 extending along the outside of the second tray sidewall 126. In such an embodiment, when the door tray 104 is properly installed relative to the mounting bracket 102, the first bracket roller 136 may be received within the first roller slot 144 and the second bracket roller 138 may be received within the second roller slot 146. Each bracket roller 136, 138 may then be translated or otherwise rolled along its corresponding roller slot 142, 144 as the door tray 104 is moved relative to the mounting bracket 102 between the retracted and extended positions.

Additionally, as particularly shown in FIG. 9, a second pair of rollers 140, 142 may be configured to be coupled to the first and second tray sidewalls 124, 126 such that each roller 140, 142 extends outwardly from its corresponding sidewall 124, 146. Specifically, a first tray roller 140 may be coupled to and extend outwardly from the outer side of the first tray sidewall 124 and a second tray roller 142 may be coupled to and extend outwardly from the outer side of the second tray sidewall 126. Moreover, as shown in FIG. 7, the mounting bracket 104 may include a first roller slot 148 defined in the first bracket sidewall 112 and a second roller slot 150 defined in the second bracket sidewall 114. In such an embodiment, when the door tray 104 is properly installed relative to the mounting bracket 102, the first tray roller 140 may be received within the first roller slot 148 and the second tray roller 142 may be received within the second roller slot 150. Each tray roller 140, 142 may then be translated or otherwise rolled along its corresponding roller slot 148, 150 as the door tray 104 is moved relative to the mounting bracket 102 between the retracted and extended positions.

It should be appreciated that, in alternative embodiments, the door module assembly 100 may only include a single pair of rollers and corresponding roller slots or the door module assembly 100 may include three or more pairs of rollers and corresponding roller slots. Additionally, it should be appreciated that, although the illustrated embodiment is shown as having a pair of rollers coupled to both the mounting bracket 102 and the door tray 104, the rollers may, in other embodiments, only be coupled to one of such components. For instance, in one embodiment, both pairs of rollers 136, 138, 140, 142 may be coupled to the first and second tray sidewalls 124, 126 at differing locations. In such an embodiment, the mounting bracket 102 may be configured to define two pairs of rollers slots for receiving the rollers 136, 138, 140, 142. Alternatively, both pairs of rollers 136, 138, 140, 142 may be coupled to the first and second bracket sidewalls 112, 114, with the corresponding roller slots being defined by the door tray 104. In even further embodiments, the door module assembly 100 may include any other suitable features to facilitate relative motion between the door tray 104 and the mounting bracket 102. For instance, as an alternative to the rollers, simple projections may be configured to extend from the bracket and/or tray sidewalls 112, 114, 124, 126. In such an embodiment, the roller slots 144, 146, 148, 148 may be configured to function as guides for the projections as the door tray 104 is moved relative to the mounting bracket 102.

Additionally, in several embodiments, the mounting bracket 102 and the door tray 104 may include corresponding detent features for providing a mechanical stop as the door tray 104 is moved relative to the mounting bracket 102. For example, as shown in FIG. 7, the mounting bracket 102 may include a pair detent clips (e.g., a first detent clip 152 and a second detent clip 154) extending inwardly from the first and second bracket sidewalls 112, 114. Each detent clip 152, 154 may be configured to define a recessed portion 156 configured to receive a corresponding detent projection 158, 160 extending outwardly from each tray sidewall 124, 126. For example, as shown in FIGS. 9 and 10, the door tray 104 may include a first detent projection 158 extending outwardly from the first tray sidewall 124 and a second detent projection 160 extending outwardly form the second tray sidewall 126. In such an embodiment, as the door tray 104 is moved to the extended position, each detent projection 158, 160 may be received within the corresponding recess 156 defined by each detent clip 152, 154, thereby preventing further outward motion of the door tray 104 relative to the mounting bracket 104.

It should be appreciated that, in one embodiment, each detent clip 152, 154 may be configured to be pushed or bowed towards its respective bracket sidewall 112, 114. As a result, when it is desired to completely remove the door tray 104 from the mounting bracket 102 (e.g., to clean the door tray 104), the detent clips 152, 154 may be pushed/bowed in the direction of the bracket sidewalls 112, 114 to allow the detent projections 158, 160 to clear the detent clips 152, 154 as the door tray 104 is moved outwardly relative to the mounting bracket 102 beyond the extended position.

Moreover, in several embodiments, the door module assembly 100 may include or more anti-racking features configured to prevent the door tray 104 from binding or otherwise getting caught as it is moved relative to the mounting bracket 102. For example, as shown in FIG. 7, in one embodiment, the mounting bracket 102 may include a bracket slot 162 extending along its bottom bracket wall 116, such as at a location generally centered between the first and second bracket sidewalls 112, 114. In such an embodiment, the door tray 104 may include a corresponding feature configured to mate with the bracket slot 162 as the door tray 104 is moved relative to the mounting bracket 102. For instance, as shown in FIG. 9, the door tray 104 may include a tray projection 164 extending outwardly from its bottom tray wall 132 (e.g., at a location centered between the first and second tray sidewalls 124, 126) that is configured to be received within the bracket slot 162. Thus, as shown in FIG. 6, as the door tray 104 is moved relative to the mounting bracket 102 between the retracted and extended positions, the tray projection 164 may slide within the bracket slot 162 to prevent the door tray 104 from binding or catching against the mounting bracket 102.

Additionally, as indicated above, the mounting bracket 102 may also include one or more mounting features configured to allow the bracket 102 to be coupled to one of the refrigerator doors 22, 24 via the mounting tabs 58 projecting outwardly from the line sidewalls 54. For example, as shown in FIGS. 7 and 8, in one embodiment, the mounting bracket 102 may include first and second mounting flanges 166, 168 defined along the first and second bracket sidewalls 112, 114 at locations adjacent to the rear bracket wall 118. In addition, as particularly shown in FIG. 8, a mounting recess 170 may be defined by each bracket sidewall 112, 114 at a location directly in front of each mounting flange 166, 168. In such an embodiment, the pair of mounting tabs 58 located at the particular mounting location at which the door module assembly 100 is being installed may be configured to be received within the mounting recesses 170 such that the mounting flanges 166, 168 are engaged between the mounting tabs 58 and the rear liner wall 52 of the corresponding refrigerator door 22, 24, thereby allowing the mounting bracket 102 (and, thus, the door tray 105) to be coupled to and supported by the door 22, 24.

Figure 11:
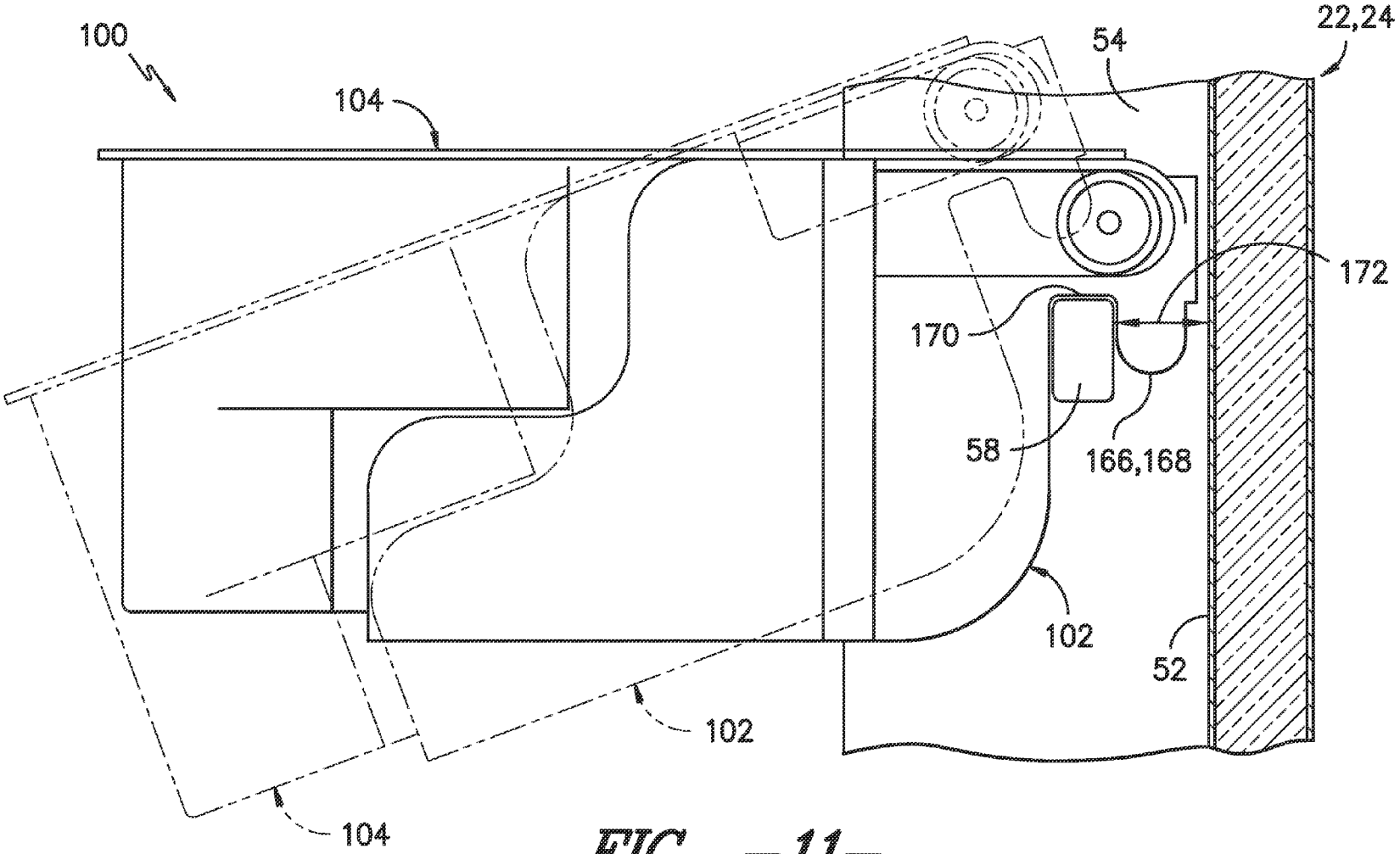
FIG. 11 illustrates a side view of the door module assembly shown in FIG. 5 as it is being installed between the liner sidewalls of a refrigerator door.

For example, FIG. 11 illustrates a side view of the door module assembly 100 shown in FIGS. 5-10 as it is being installed onto a refrigerator door 22, 24. Specifically, the door module assembly 100 is shown in both in an initial position (dashed lines) prior to the mounting bracket 102 being coupled to the refrigerator door 22, 24 and a final position (solid lines) after the mounting bracket 102 has been coupled to the door 22, 24. As shown, the door module assembly 100 may be configured to be inserted between the liner sidewalls 54 and pushed back towards the rear liner wall 52 of the refrigerator door 22, 24 to allow the mounting flanges 166, 168 to be aligned with a gap 172 defined between the mounting tabs 58 and the rear liner wall 52. The door module assembly 100 may then be moved vertically downward so that both the mounting flanges 166, 168 are engaged between the mounting tabs 58 and the rear liner wall 42 and the mounting tabs 58 are received within the corresponding mounting recesses 170.

Figure 12:
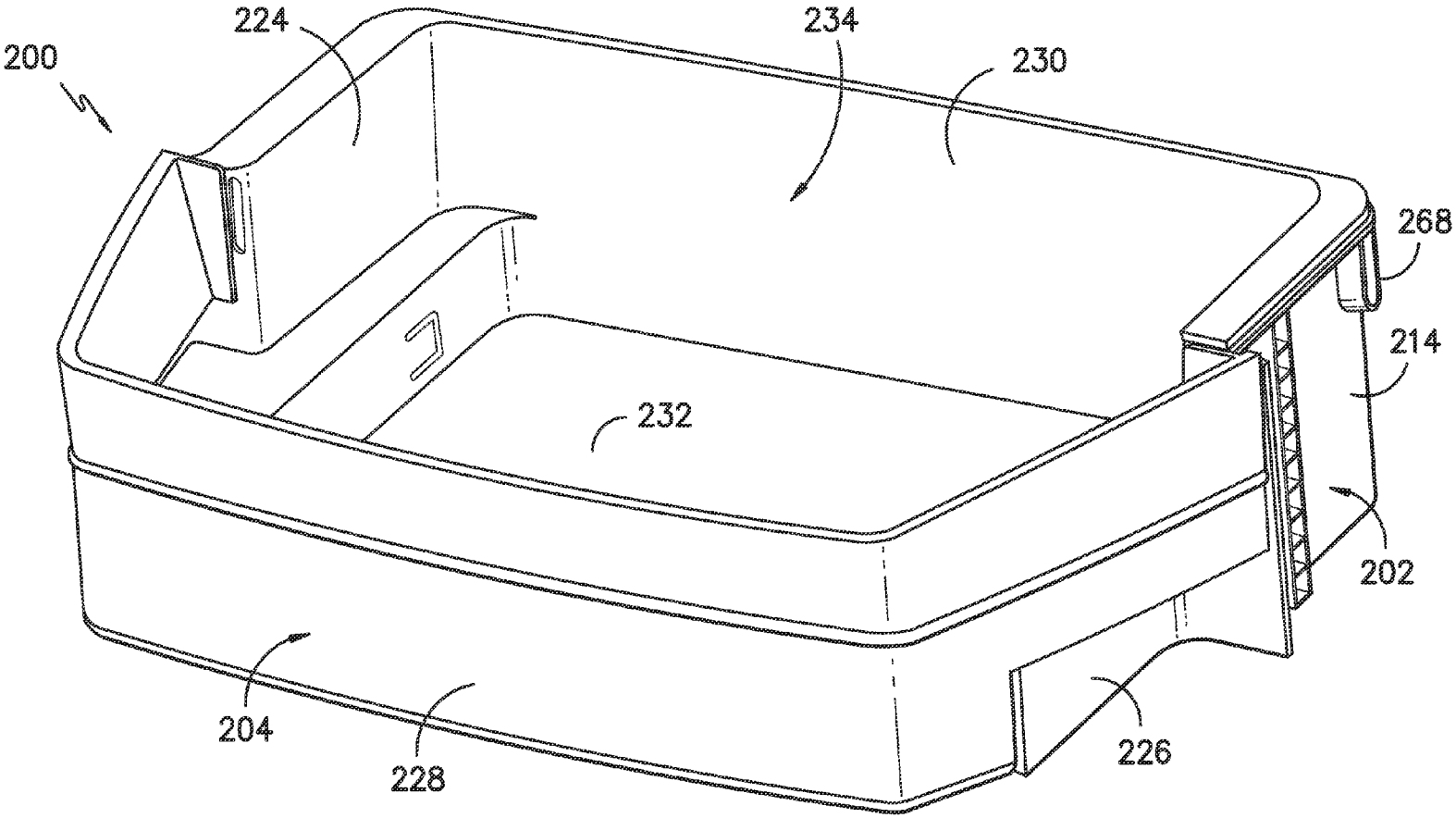
FIG. 12 illustrates a top, front perspective view of another embodiment of a door module assembly suitable for use within a refrigerator appliance in accordance with aspects of the present subject matter, particularly illustrating a door tray of the door module assembly in a retracted position.
Figure 13:
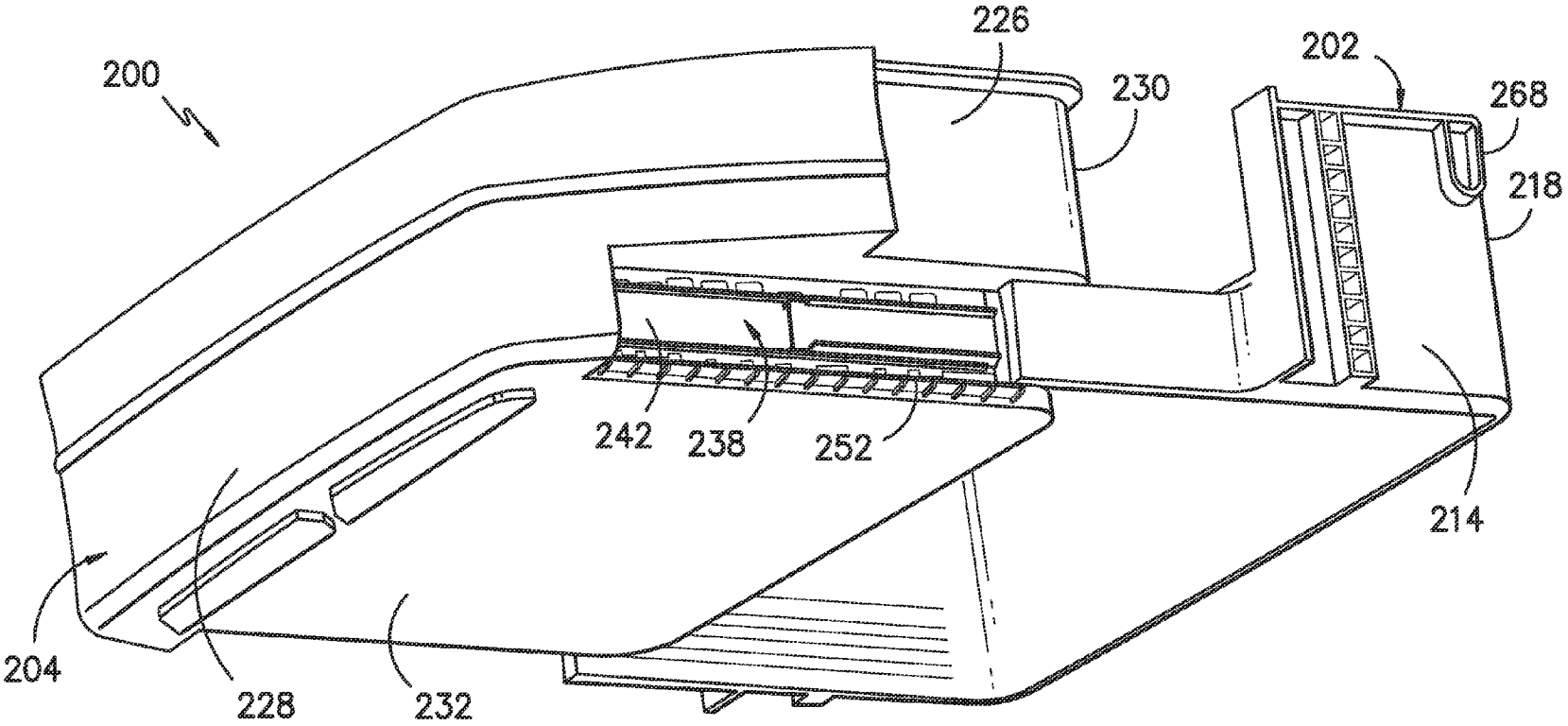
FIG. 13 illustrates a bottom, front perspective view of the door module assembly shown in FIG. 12, particularly illustrating the door tray in an extended position.
Figure 14:
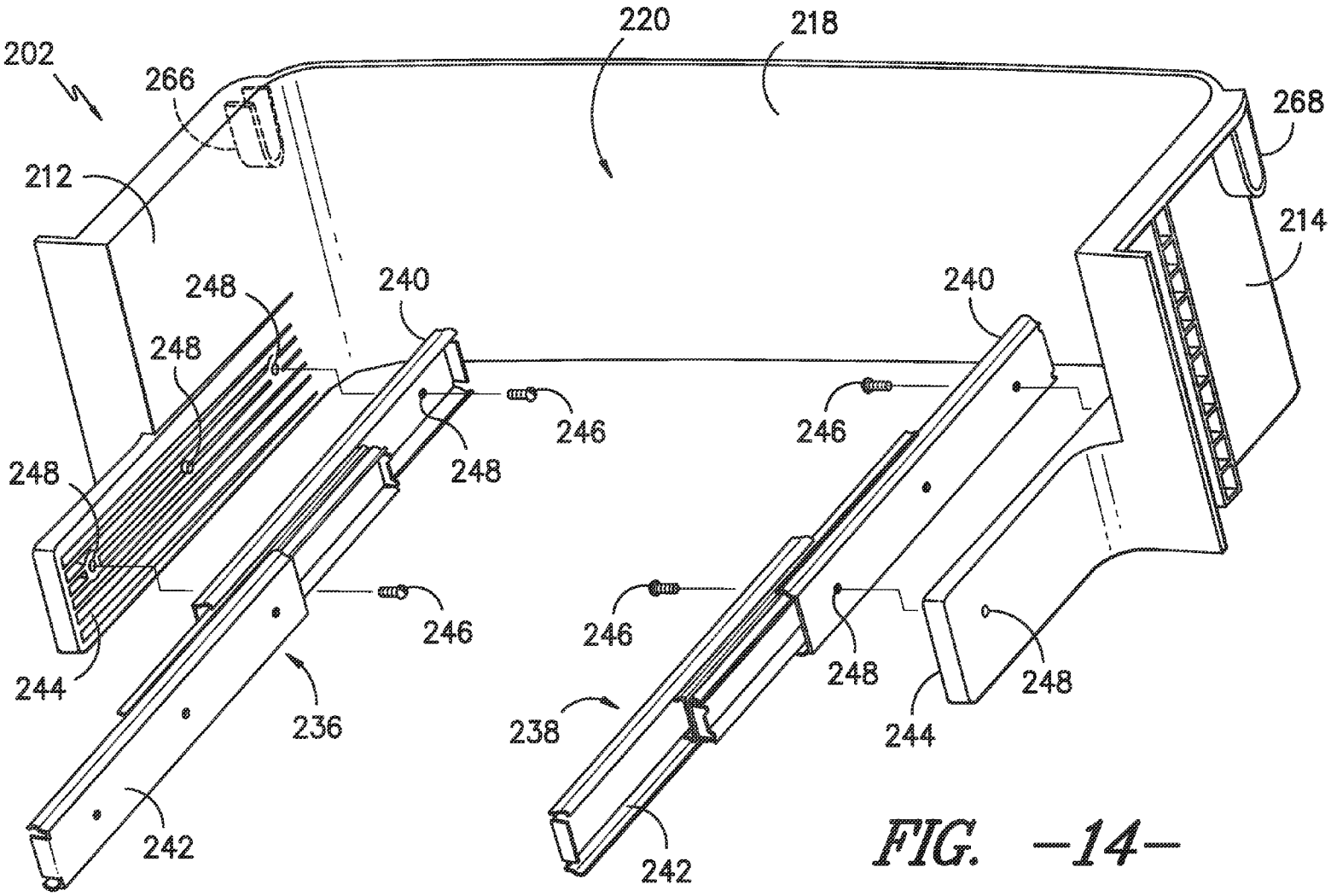
FIG. 14 illustrates a front, top perspective view of a mounting bracket of the door module assembly shown in FIG. 12.
Figure 15:
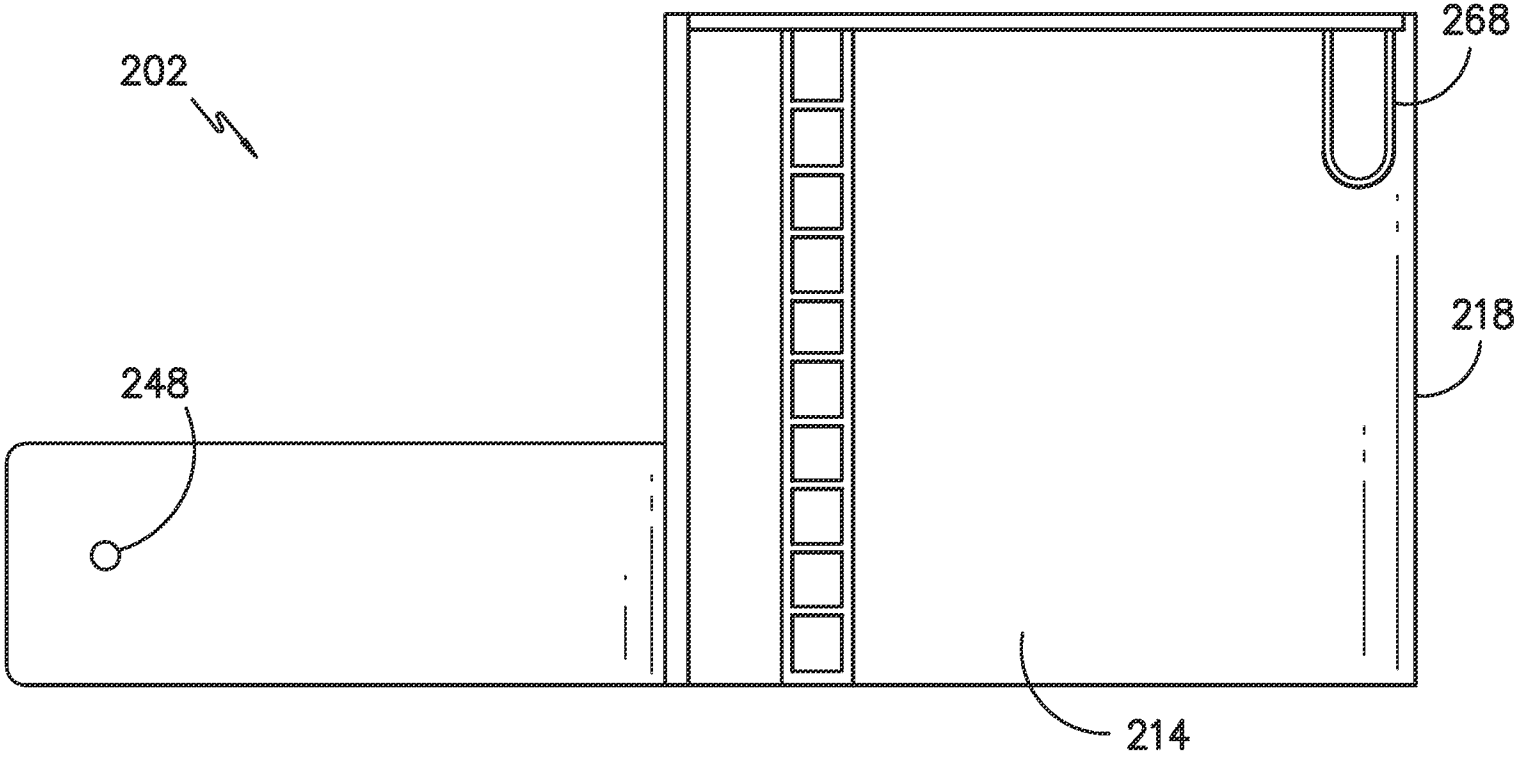
FIG. 15 illustrates a side view of the mounting bracket shown in FIG. 14.
Figure 16:
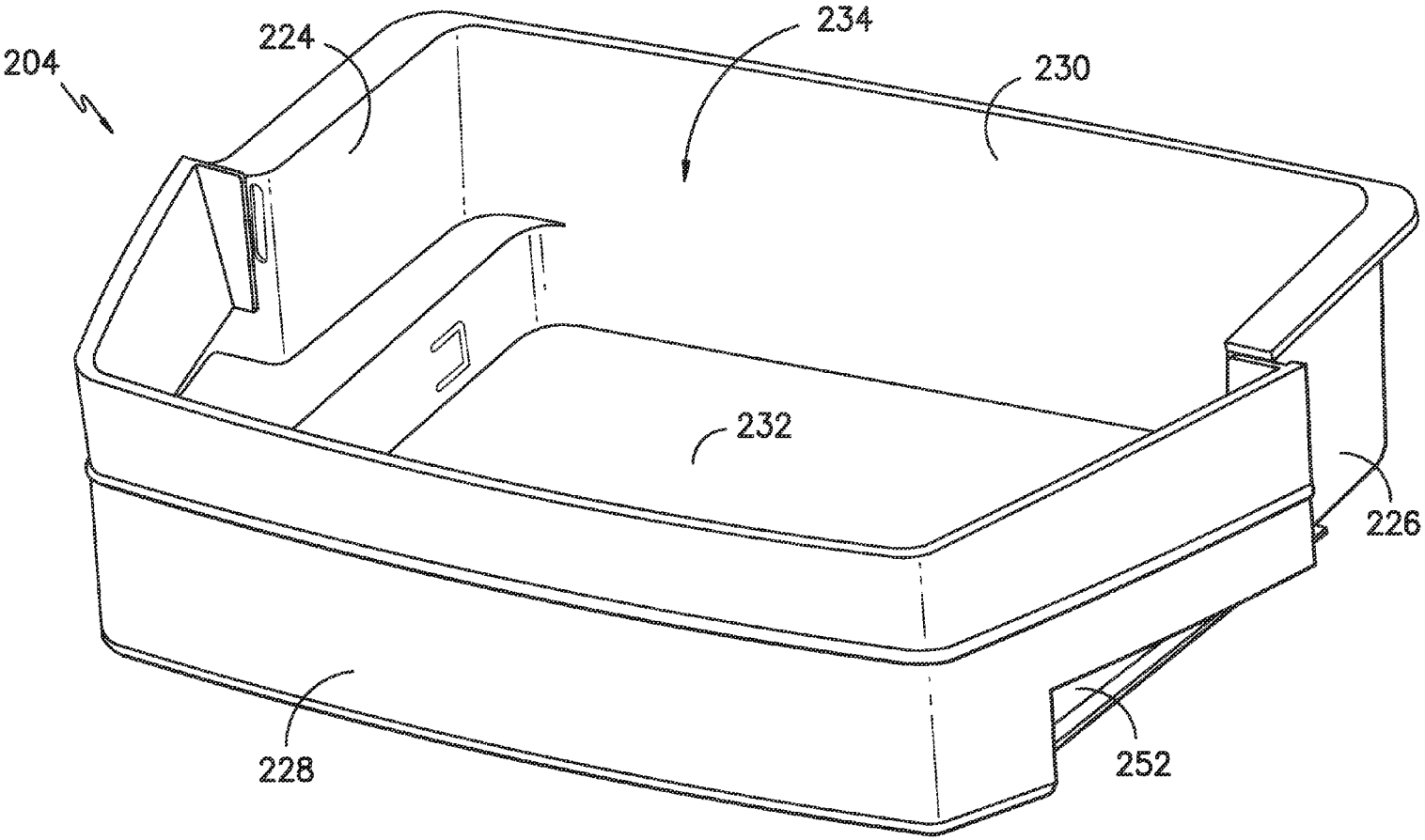
FIG. 16 illustrates a top, front perspective view of the door tray shown in FIG. 12.
Figure 17:
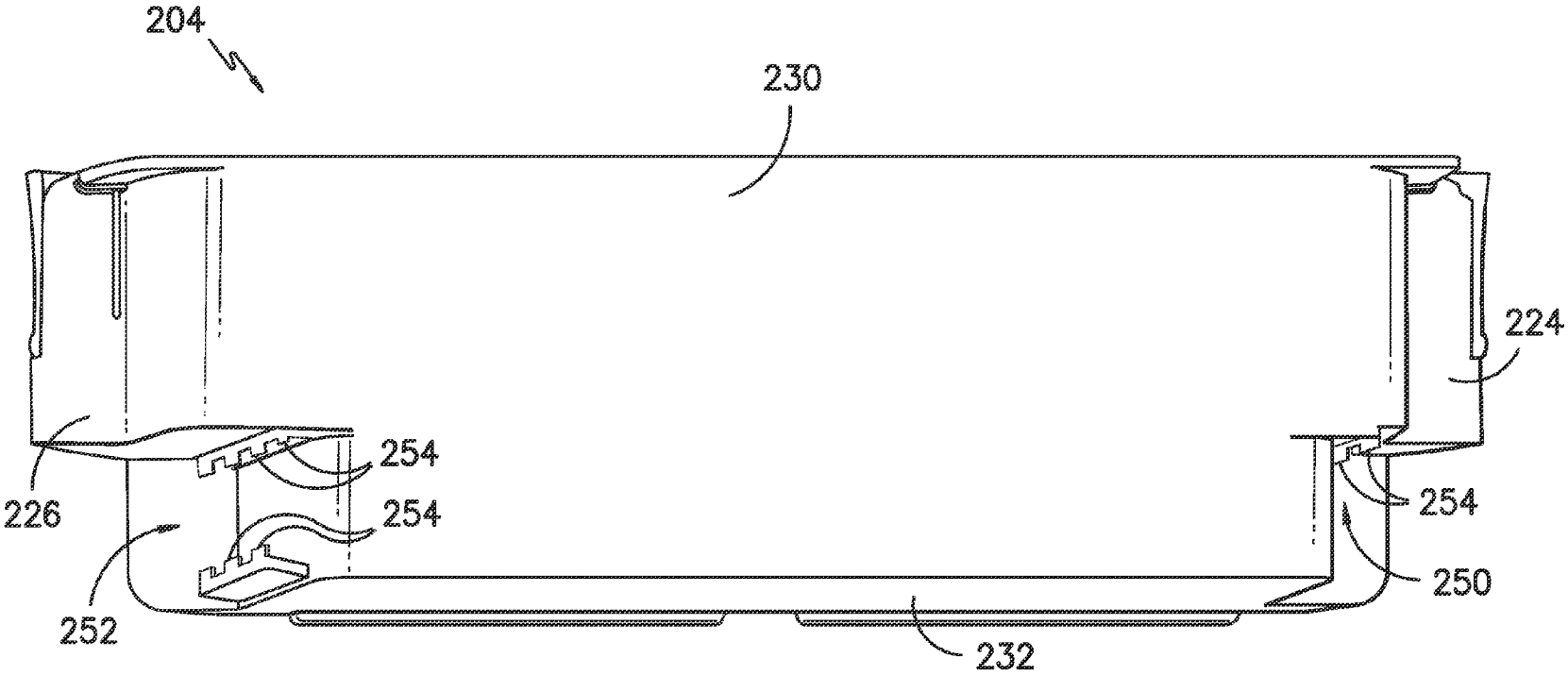
FIG. 17 illustrates a rear perspective view of the door tray shown in FIG. 16.

Referring now to FIGS. 12-17, several views of another embodiment of a door module assembly 200 are illustrated in accordance with aspects of the present subject matter. Specifically, FIGS. 12 and 13 illustrates top and bottom perspective views, respectively, of the door module assembly 100, with FIG. 12 showing a door tray 204 of the door module assembly 200 in the retracted position and FIG. 13 showing the door tray 204 in the extended position. FIGS. 14 and 15 illustrate perspective and side views, respectively, of a mounting bracket 202 of the door module assembly 200. Additionally, FIGS. 16 and 17 illustrate front and rear perspective views, respectively, of the door tray 204 of the door module assembly 200.

In general, the door module assembly 200 may be configured the same as or similar to the door module assembly 100 described above with reference to FIGS. 5-10. For instance, door module assembly 200 may generally include a mounting bracket 202 and a door tray 204 movable relative to the mounting bracket 202 between retracted and extended positions. As particularly shown in FIG. 14, the mounting bracket 202 may generally include a first bracket sidewall 212, a second bracket sidewall 214 and a rear bracket wall 218 extending between the first and second bracket sidewalls 212, 214. Similar to the embodiment described above, the first bracket sidewall 212 may be spaced apart from the second bracket sidewall 214 such that an open bracket volume 220 is defined between the sidewalls 212, 214, thereby allowing at least a portion of the door tray 204 to be received within the open volume 220.

Additionally, as particularly shown in FIG. 16, the door tray 204 may generally include a first tray sidewall 224, a second tray sidewall 226, a front tray wall 228, a rear tray wall 230 and a bottom tray wall 232. In general, the various walls 224, 226, 228, 230, 232 may be positioned relative to one another so that an open storage area or volume 234 is defined between the walls. As indicated above, the open storage volume 234 may be configured for receiving and/or containing refrigerated items, such as beverage containers and/or other food articles.

Moreover, in several embodiments, the door module assembly 200 may include one or more translation devices associated with the mounting bracket 202 and/or the door tray 204 to allow the door tray 204 to be moved relative to the mounting bracket 202 between the retracted and extended positions. As shown in the illustrated embodiment, the translation devices may correspond to slide mechanisms 236, 238 coupled between the adjacent sidewalls 212, 214, 224, 226 of the mounting bracket 202 and the door tray 204. Specifically, as shown in FIGS. 13 and 14, the door module assembly 200 may include a first slide mechanism 236 configured to be coupled between the first tray sidewall 124 and the first bracket sidewall 112 and a second slide mechanism 238 configured to be coupled between the second tray sidewall 226 and the second bracket sidewall 214.

In general, the slide mechanisms 236, 238 may be configured the same as or similar to any suitable extension slides or linear-motion bearings known in the art. For example, as shown in FIG. 14, each slide mechanism 236, 238 may include a first slide component 240 and a second slide component 242, with the first and second slide components 240, 242 being configured to be slid or moved relative to one another along a linear path extending parallel to the lengthwise direction of each slide mechanism 236, 238. As is generally understood, any suitable components may be positioned at the interface defined between the first and second slide components 240, 242 to allow such components to be moved linearly relative to one another, such as rollers, ball bearings and/or the like.

In several embodiments, each bracket sidewall 212, 214 may define a mounting surface 244 (one of which is shown) along its inner side for coupling the first slide component 240 or the second slide component 242 of each slide mechanism 236, 238 to the mounting bracket 202. For instance, as shown in FIG. 14, in one embodiment, the first slide component 240 of each slide mechanism 236, 238 may be configured to be mounted flush against the mounting surfaces 244 defined by the bracket sidewalls 212, 214. In such an embodiment, suitable mechanical fasteners 246 (e.g., bolts, screws or pins) may be inserted through aligned openings 248 defined in both the slide components 240 and the bracket sidewalls 212, 214 to allow each slide mechanism 236, 238 to be secured to the mounting bracket 202.

Additionally, in several embodiments, suitable mounting slots 250, 252 may be defined along the outer sides of the tray sidewalls 124, 126 for receiving the second slide component 242 of each slide mechanism 236, 238 (or the first slide component 240, depending on which component is coupled to the mounting bracket 202). For instance, as shown in FIG. 17, a first mounting slot 250 may be may defined along the first tray sidewall 224 for receiving the second slide component 242 of one of the slide mechanisms 236, 238 and a second mounting slot 252 may be defined along the second tray sidewall 226 for receiving the second slide component 242 of the other slide mechanism 236, 238. In such an embodiment, suitable engagement features, such a vertically extending teeth 254, may be provided along the length of each mounting slot 250, 252 in order to retain the slide components 242 within the mounting slots 250, 252. However, it should be appreciated that, in alternative embodiments, the slide components 242 may be configured to be coupled to the tray sidewalls 224, 226 using suitable mechanical fasteners (e.g., similar to the manner in which the slide mechanisms 236, 238 are coupled to the mounting bracket 202).

It should also be appreciated that the door module assembly 200 may also include any other suitable components and/or features, such as any of the other components and/or features described above with reference to FIGS. 5-10. For instance, the door module assembly 200 may include suitable detent features for limiting motion of the door tray 204 relative to the mounting bracket 202 and/or suitable anti-racking features for preventing the door tray 204 from binding as it is moved relative to the mounting bracket 202.

Additionally, similar to the mounting bracket 102 described above with reference to FIGS. 5-10, the mounting bracket 202 may also include one or more mounting features for coupling the bracket 202 to one of the refrigerator doors 22, 24 via the mounting tabs 58. For example, as shown in FIGS. 14 and 15, the mounting bracket 202 may include first and second mounting flanges 266, 268 defined along the first and second bracket sidewalls 212, 214 at locations adjacent to the rear bracket wall 218. As such, similar to that shown in FIG. 11, the mounting flanges 266, 268 may be inserted between the rear liner wall 52 of one of the refrigerator doors 22, 24 and a given pair of mounting tabs 58 to allow the mounting bracket 202 (and, thus, the door tray 204) to be coupled to and supported by the door 22, 24.

Figure 18:
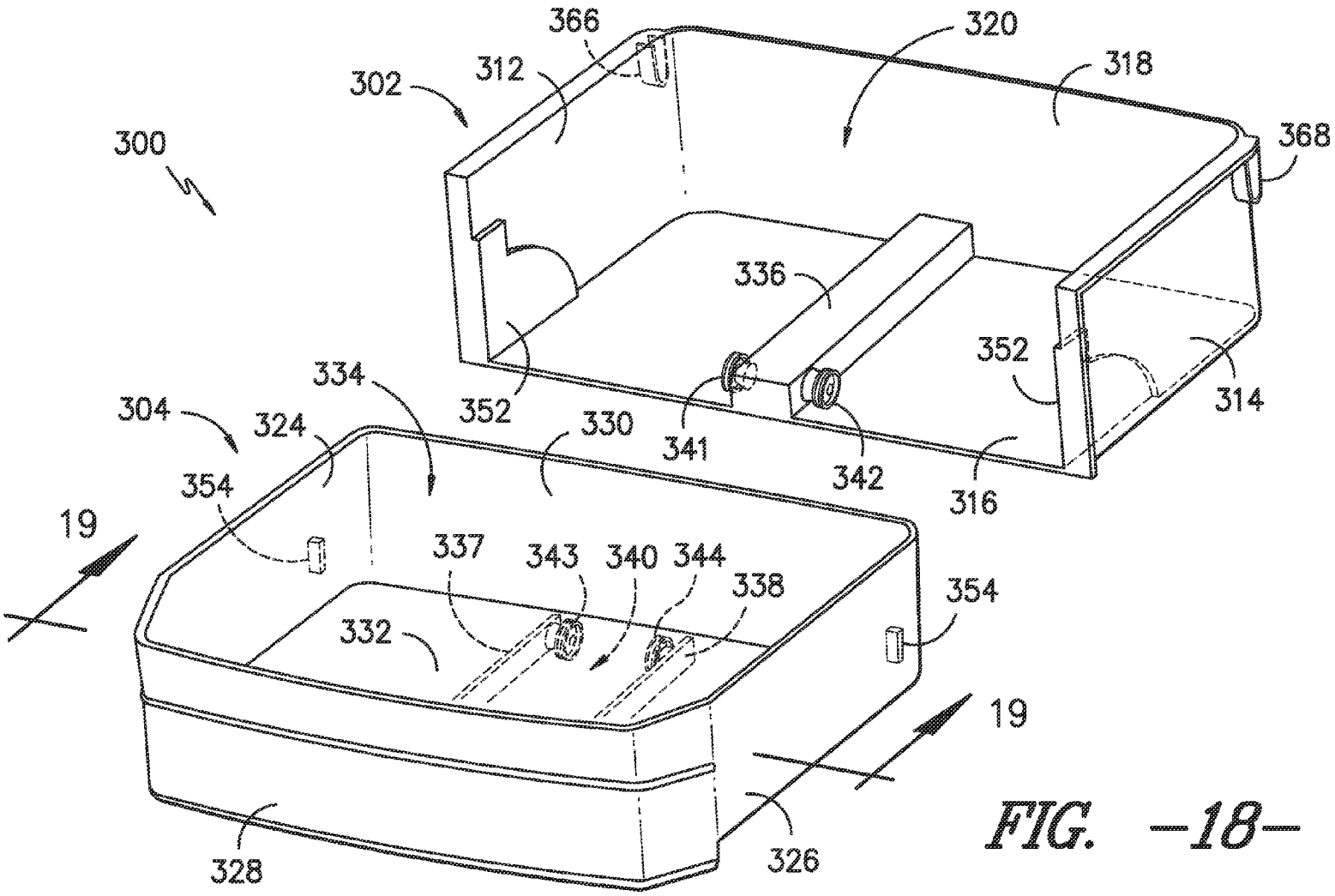
FIG. 18 illustrates a front perspective view of a further embodiment of a door module assembly suitable for use within a refrigerator appliance in accordance with aspects of the present subject matter, particularly illustrating a door tray of the door module assembly exploded away from a mounting bracket of the door module assembly.
Figure 19:
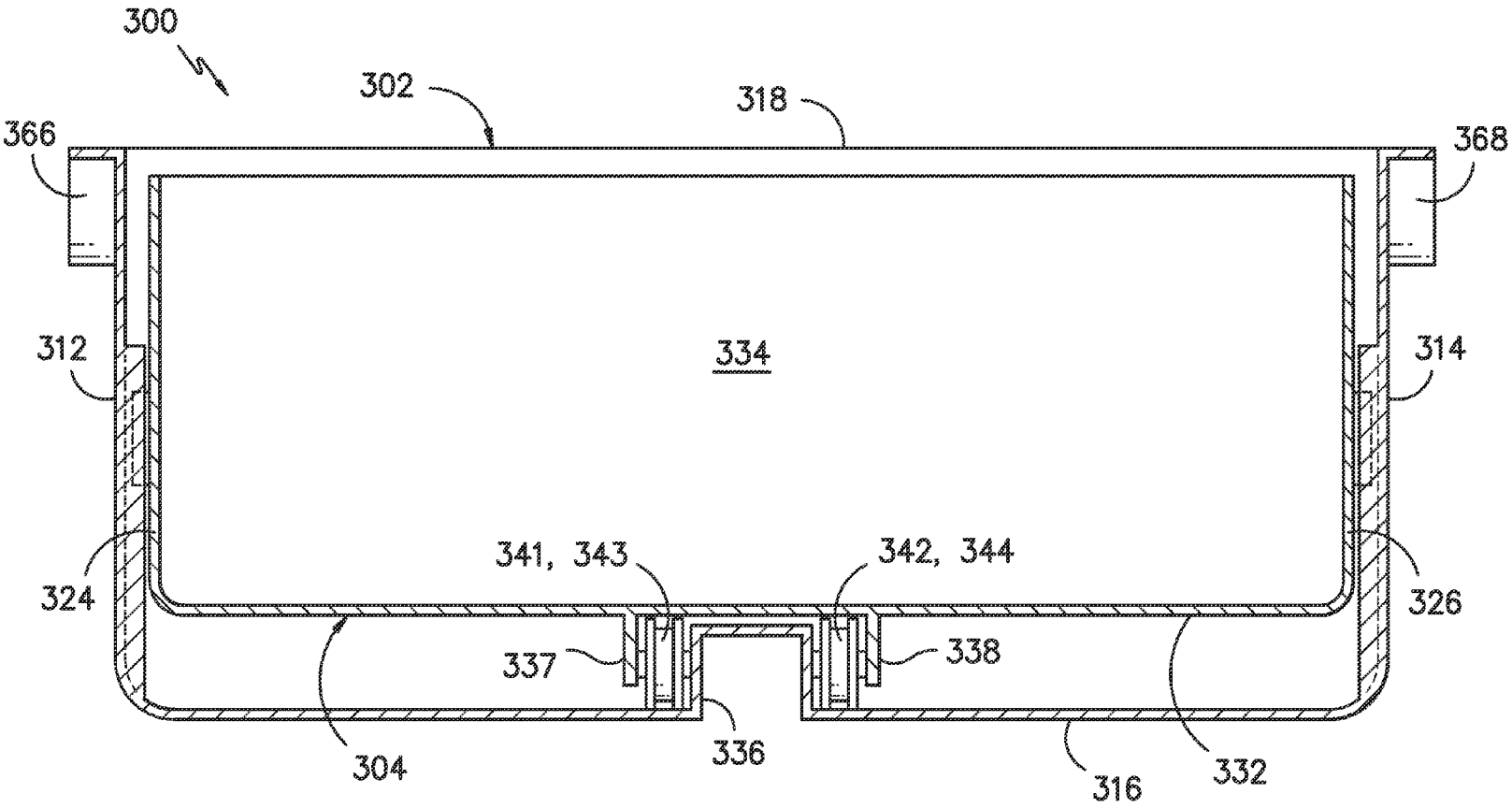
FIG. 19 illustrates a cross-sectional view of the door module assembly shown in FIG. 18 taken about line 19-19.
Figure 20:
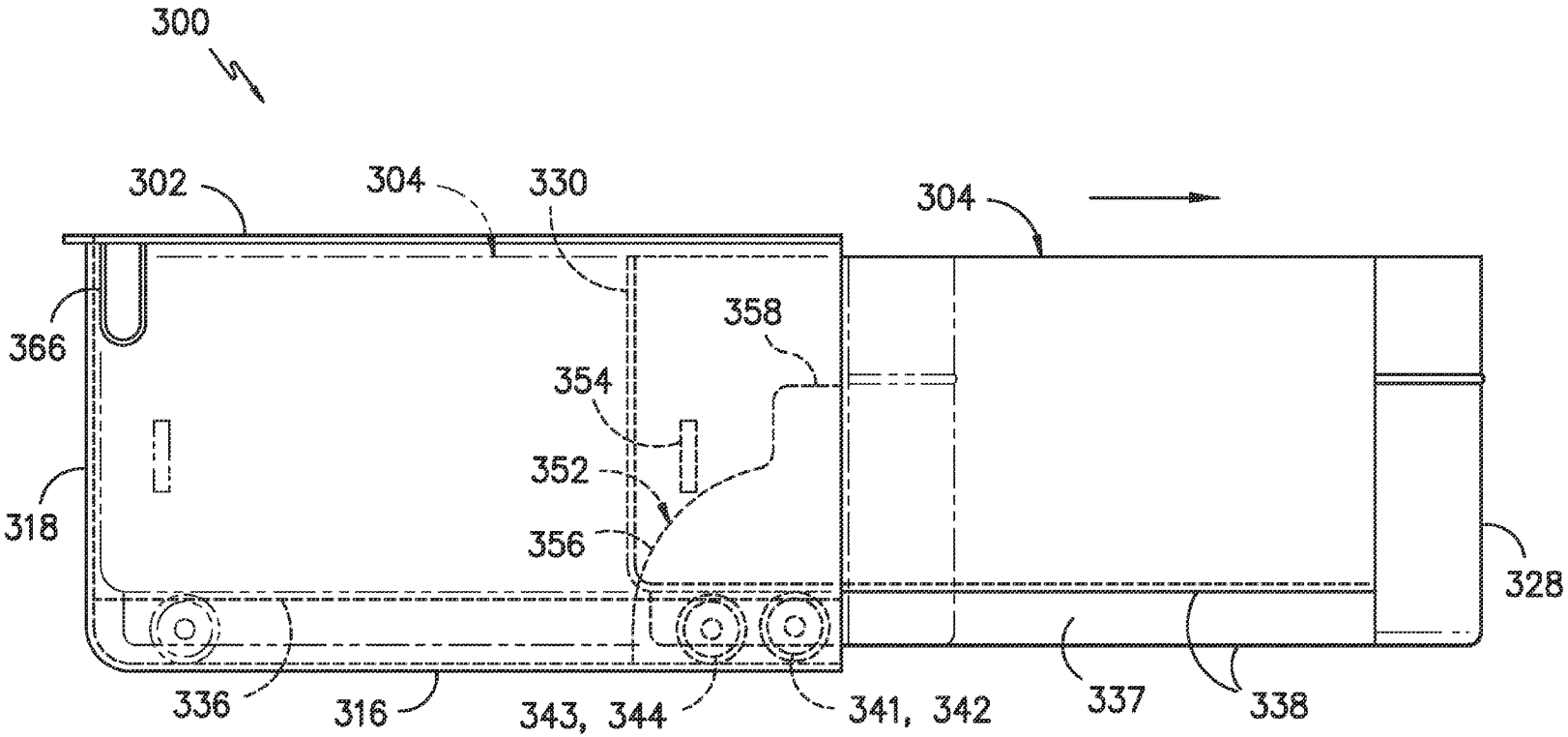
FIG. 20 illustrates a side view of the door module assembly shown in FIG. 18 with the door tray installed within the mounting bracket, particularly illustrating the door tray in both a retracted position (phantom lines) and an extended position (solid lines)
Figure 21:
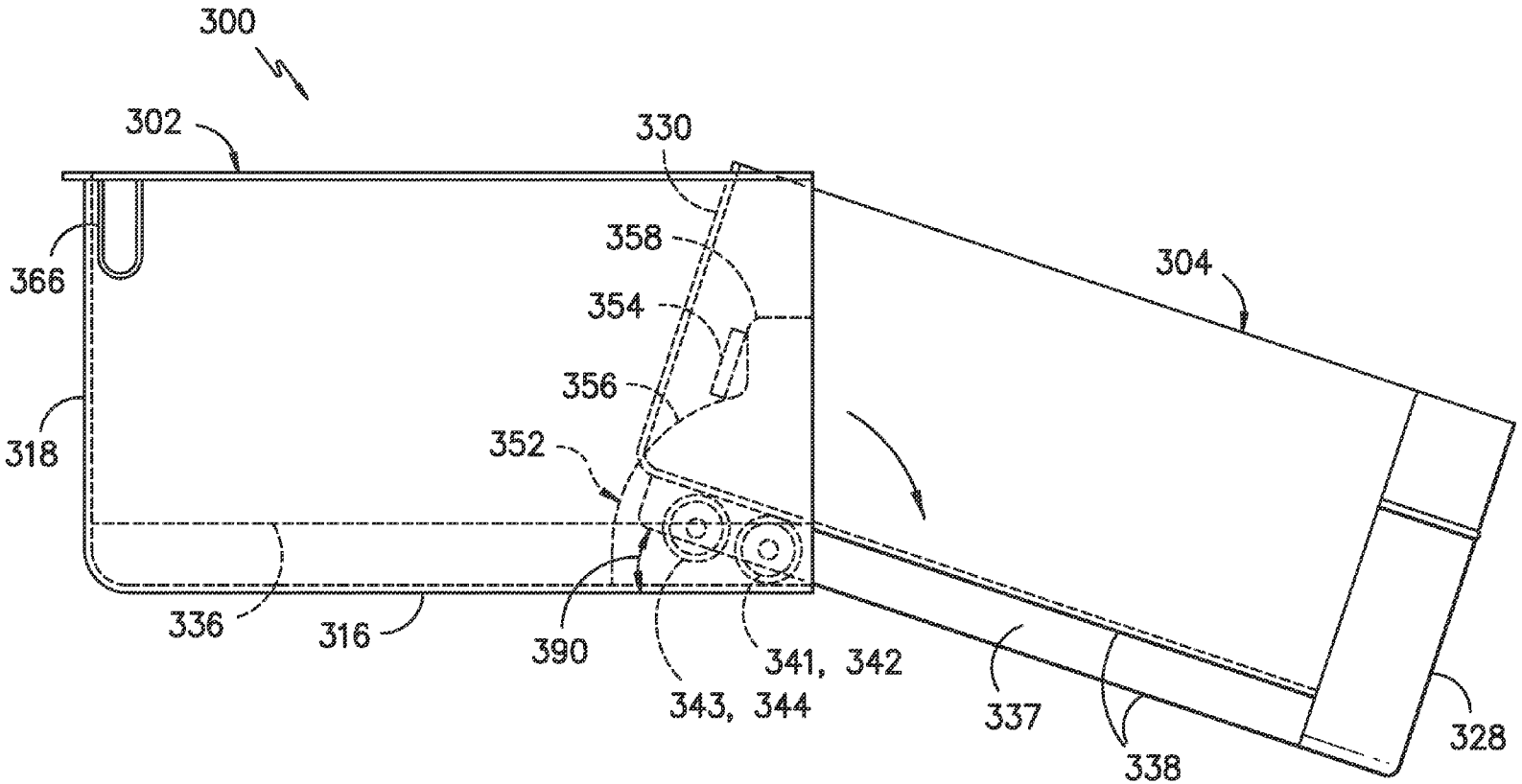
FIG. 21 illustrates another side view of the door module assembly shown in FIG. 18, particularly illustrating the door tray after it has been moved from the extended position to a pivoted position.

Referring now to FIGS. 18-21, several views of another embodiment of a door module assembly 300 are illustrated in accordance with aspects of the present subject matter. Specifically, FIG. 18 illustrates a top, perspective view of the door module assembly 300, with a door tray 304 of the assembly 300 being exploded away from a mounting bracket 302 of the assembly 300. FIG. 19 illustrates a cross-sectional view of the door module assembly 300 shown in FIG. 18 taken about line 19-19. Additionally, FIGS. 20 and 21 illustrate side, assembled views of the door module assembly 300 shown in FIG. 18, with FIG. 20 illustrating the door tray 304 being moved relative to the mounting bracket 302 from a retracted position (phantom lines) to an extended position (solid lines) and FIG. 21 illustrating the door tray 304 after it has been moved from the extended position shown in FIG. 20 to a pivoted position.

In general, the door module assembly 300 may be configured the same as or similar to the door module assemblies 100, 200 described above with reference to FIGS. 5-17. For instance, door module assembly 300 may generally include a mounting bracket 302 and a door tray 304 movable relative to the mounting bracket 302 between retracted and extended positions. As particularly shown in FIG. 18, the mounting bracket 302 may generally include a first bracket sidewall 312, a second bracket sidewall 314 and bottom and rear bracket walls 316, 318, respectively, extending between the first and second bracket sidewalls 312, 314. Similar to the embodiments described above, the first bracket sidewall 312 may be spaced apart from the second bracket sidewall 314 such that an open bracket volume 320 is defined between the sidewalls 312, 314, thereby allowing at least a portion of the door tray 304 to be received within the open volume 320.

Additionally, as particularly shown in FIG. 18, the door tray 304 may generally include a first tray sidewall 324, a second tray sidewall 326, a front tray wall 328, a rear tray wall 330 and a bottom tray wall 332. In general, the various walls 324, 326, 328, 330, 332 may be positioned relative to one another so that an open storage area or volume 334 is defined between the walls. As indicated above, the open storage volume 334 may be configured for receiving and/or containing refrigerated items, such as beverage containers and/or other food articles.

Moreover, in several embodiments, the door module assembly 300 may include one or more translation devices associated with the mounting bracket 302 and/or the door tray 304 to allow the door tray 304 to be moved relative to the mounting bracket 302 between the retracted and extended positions. However, in contrast to the embodiments described above in which the translation device(s) were positioned between the adjacent sidewalls of the assembly components, the illustrated translation device(s) may be configured to be positioned between the adjacent bottom walls 316, 332 of the mounting bracket 302 and the door tray 304.

Specifically, as shown in the illustrated embodiment, the mounting bracket 302 may include a vertical bracket projection 336 extending upwardly from the bottom bracket wall 316. As particularly shown in FIG. 18, the vertical bracket projection 336 may generally be configured to extend lengthwise between the bracket sidewalls 312, 314 (e.g., at a generally central location along the bottom bracket wall 316) from the front of the mounting bracket 302 to the rear bracket wall 318. In addition, the door tray 304 may include first and second vertical tray projections 337, 338 extending outwardly from the bottom tray wall 332 so as to define a slot 340 for receiving the vertical bracket projection 336. In such an embodiment, one or more rollers may be positioned between the adjacent bottom walls 316, 332 of the mounting bracket 302 and the door tray 304 to allow the tray 304 to be easily and efficiently moved relative to the mounting bracket 302 between the retracted and extended positions. For instance, as shown in the illustrated embodiment, a first pair of bracket rollers 341, 342 may be coupled to the vertical bracket projection 336 (e.g., at the front of the mounting bracket 302) and may be configured to extend outwardly therefrom such that the rollers 341, 342 contact and roll along the bottom tray wall 332 at locations between the first and second vertical tray projections 337, 338 as the door tray 304 is moved relative to the mounting bracket 302. Additionally, in one embodiment, a second pair of tray rollers 343, 344 may be coupled to the first and second vertical projections 337, 338 (e.g., at a location adjacent to the rear tray wall 336) and may be configured to extend outwardly therefrom such that the rollers 337, 338 contact and roll along the bottom bracket wall 316 at locations along either side of vertical bracket projection 336 as the door tray 304 is moved relative to the mounting bracket 302.

It should also be appreciated that the door module assembly 300 may also include any other suitable components and/or features, such as any of the other components and/or features described above with reference to FIGS. 5-17. For instance, as shown in the illustrated embodiment, the door module assembly 300 may include suitable detent features for limiting motion of the door tray 304 relative to the mounting bracket 302. Specifically, detent projections 352 may be formed along the inner sides of the bracket sidewalls 312, 314 that are configured to engage corresponding detent tabs 354 projecting outwardly from the tray sidewalls 324, 326. Thus, as the door tray 304 is moved from the retracted position to the extended position, the detent tabs 354 of the door tray 304 may contact the detent projections 326 of the mounting bracket 302 to limit further horizontal movement of the door tray 304 relative to the mounting bracket 302.

Additionally, similar to the mounting brackets 102, 202 described above with reference to FIGS. 5-17, the mounting bracket 302 may also include one or more mounting features for coupling the bracket 302 to one of the refrigerator doors 22, 24 via the mounting tabs 58. For example, as shown in the illustrated embodiment, the mounting bracket 302 may include first and second mounting flanges 366, 368 defined along the first and second bracket sidewalls 312, 314 at locations adjacent to the rear bracket wall 318. As such, similar to that shown in FIG. 11, the mounting flanges 366, 368 may be inserted between the rear liner wall 52 of one of the refrigerator doors 22, 24 and a given pair of mounting tabs 58 to allow the mounting bracket 302 (and, thus, the door tray 304) to be coupled to and supported by the door 22, 24.

Moreover, in addition to being able to be move the door tray 304 relative to the mounting bracket 302 between the retracted and extended positions, the door module assembly 300 may also be configured such that the door tray 304 may be pivoted relative to the mounting bracket 302 between the extended position and a pivoted position. For example, FIG. 21 illustrates the door tray 304 moved to the pivoted position relative to the mounting bracket 302 such that a pivot angle 390 is defined between a portion of the door tray 304 (e.g., the bottom tray wall 332) and a portion of the mounting bracket 302 (e.g., the bottom bracket wall 316). By allowing such pivotal motion of the door tray 304, the open storage volume 334 defined by the door tray 304 may be made even more accessible to a user of the associated refrigerator appliance 20 so that refrigerated items may be quickly and easily loaded into and/or unloaded from the door tray 304.

It should be appreciated that, in general, any suitable pivot angle 390 may be defined between the door tray 304 and the mounting bracket 302 when the door tray 304 is moved to the pivoted position. However, in several embodiments, the pivot angle 390 may generally range from greater than 0 degrees to less than about 45 degrees, such as from about 5 degrees to about 30 degrees or from about 10 degrees to about 20 degrees and any other subranges therebetween.

Additionally, in several embodiments, the detent projections 352 defined along the bracket sidewalls 312, 314 may be configured to accommodate the pivoting motion of the door tray 304 relative to the mounting bracket 302. For instance, as shown in FIGS. 20 and 21, the detent projections 352 may be configured to define curved surfaces 356 such that the corresponding detent tabs 354 slide along such surfaces 356 as the door tray 304 is provided relative to the mounting bracket 302. Moreover, as shown in the illustrated embodiment, each detent projection 352 may also include a vertical portion 358 extending upward from the curved surfaces 356 that is configured to function as a mechanical stop for the detent tabs 354 when the door tray 304 has reached the maximum allowable pivot angle 390 to prevent further pivoting of the door tray 304 relative to the mounting bracket 302.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A door module assembly for a refrigerator door of a refrigerator appliance, the door module assembly comprising:

a mounting bracket configured to be removably coupled to the refrigerator door to allow the mounting bracket to be moveable between a plurality of mounting locations defined along a height of the refrigerator door, the mounting bracket including a first bracket sidewall and a second bracket sidewall, the first bracket sidewall being spaced apart from the second bracket sidewall so as to define an open bracket volume between the first and second bracket sidewalls;

a door tray configured to be at least partially received within the open bracket volume, the door tray including a first tray sidewall, a second tray sidewall, a front tray wall and a rear tray wall, the door tray further including a bottom tray wall and an open-ended top so as to define an open tray volume between the first and second tray sidewalls and between the front and rear tray walls that extends vertically upward from the bottom tray wall, the open tray volume at least partially defining a vertical storage height for storing refrigerated items that extend from the bottom tray wall to a location vertically above the open-ended top of the door tray; and at least one translation device configured in operative association with adjacent walls of the mounting bracket and the door tray, the at least one translation device comprising:

first and second bracket rollers, the first bracket roller being coupled to the first bracket sidewall and being received within a first tray slot extending along the first tray sidewall, the second bracket roller being coupled to the second bracket sidewall and being received within a second tray slot extending along the second tray sidewall; and first and second tray rollers, the first tray roller being coupled to the first tray sidewall and being received within a first bracket slot extending along the first bracket sidewall, the second tray roller being coupled to the second tray sidewall and being received within a second bracket slot extending along the second bracket sidewall;

wherein the at least one translation device is configured such that the door tray is movable relative to the mounting bracket in a horizontal direction between a retracted position, wherein the front tray wall is spaced apart from a forward edge of the first and second bracket sidewalls by a first distance, and an extended position, wherein the front tray wall is spaced apart from the forward edge by a second distance that is greater than the first distance, wherein the open tray volume defined by the door tray is accessible when the door tray is in both the retracted position and the extended position, the open tray volume being exposed to an open interior of the refrigerator appliance when the door tray is in the retracted position and the refrigerator door is closed.

2. The door module assembly of claim 1, wherein the first tray slot is defined between opposed slot walls projecting outwardly from the first tray sidewall and the second tray slot is defined between opposed slot walls projecting outwardly from the second tray sidewall.

3. The door module assembly of claim 1, wherein the first bracket slot is defined through the first bracket sidewall and the second bracket slot is defined through the second bracket sidewall.

4. The door module assembly of claim 1, wherein the mounting bracket includes a bottom bracket wall extending between the first and second bracket sidewalls, the bottom bracket wall defining a bracket slot, the bottom tray wall including an outwardly extending tray projection configured to be slidably received within the bracket slot as the door tray is moved between the retracted and extended positions.

5. The door module assembly of claim 1, wherein the mounting bracket includes a detent clip extending inwardly from at least one of the first bracket sidewall or the second bracket sidewall, the door tray including a corresponding detent projection extending outwardly from at least one of the first tray sidewall or the second tray sidewall, the detent projection being configured to be received within a recessed portion defined by the detect clip.

6. A refrigerator appliance, comprising:

a housing defining a refrigerator chamber;

a refrigerator door pivotally coupled to the housing, the refrigerator door movable between an opened position and a closed position for accessing the refrigerator chamber, the refrigerator door including a liner defining liner sidewalls;

a door module assembly removably coupled between the liner sidewalls, the door module assembly comprising:

a mounting bracket including a first bracket sidewall and a second bracket sidewall, the first bracket sidewall being spaced apart from the second bracket sidewall so as to define an open bracket volume between the first and second bracket sidewalls;

a door tray configured to be at least partially received within the open bracket volume, the door tray including a first tray sidewall, a second tray sidewall, a front tray wall and a rear tray wall, the door tray further including a bottom tray wall and an open-ended top so as to define an open tray volume between the first and second tray sidewalls and between the front and rear tray walls that extends vertically upward from the bottom tray wall, the open tray volume at least partially defining a vertical storage height for storing refrigerated items that extend from the bottom tray wall to a location vertically above the open-ended top of the door tray; and at least one translation device configured in operative association with adjacent walls of the mounting bracket and the door tray, the at least one translation device comprising:

first and second bracket rollers, the first bracket roller being coupled to the first bracket sidewall and being received within a first tray slot extending along the first tray sidewall, the second bracket roller being coupled to the second bracket sidewall and being received within a second tray slot extending along the second tray sidewall; and first and second tray rollers, the first tray roller being coupled to the first tray sidewall and being received within a first bracket slot extending along the first bracket sidewall, the second tray roller being coupled to the second tray sidewall and being received within a second bracket slot extending along the second bracket sidewall;

wherein the at least one translation device is configured such that the door tray is movable relative to the mounting bracket in a horizontal direction between a retracted position, wherein the front tray wall is spaced apart from a forward edge of the first and second bracket sidewalls by a first distance, and an extended position, wherein the front tray wall is spaced apart from the forward edge by a second distance that is greater than the first distance, wherein the open tray volume defined by the door tray is accessible when the door tray is in both the retracted position and the extended position, the open tray volume being exposed to an open interior of the refrigerator appliance when the door tray is in the retracted position and the refrigerator door is closed.

7. The refrigerator appliance of claim 6, wherein the first tray slot is defined between opposed slot walls projecting outwardly from the first tray sidewall and the second tray slot is defined between opposed slot walls projecting outwardly from the second tray sidewall.

8. The refrigerator appliance of claim 6, wherein the first bracket slot is defined through the first bracket sidewall and the second bracket slot is defined through the second bracket sidewall.

9. The refrigerator appliance of claim 6, wherein the mounting bracket includes a detent clip extending inwardly from at least one of the first bracket sidewall or the second bracket sidewall, the door tray including a corresponding detent projection extending outwardly from at least one of the first tray sidewall or the second tray sidewall, the detent projection being configured to be received within a recessed portion defined by the detect clip.

10. The refrigerator appliance of claim 6, wherein a plurality of mounting locations are defined along a height of the refrigerator door, the refrigerator door including a pair of mounting tabs at each of the plurality of mounting locations, the mounting bracket defining corresponding mounting flanges configured to engage the pair of mounting tabs for coupling the door module assembly to the refrigerator door.

* * * * *